US007018974B2

(12) United States Patent
Frankenbach et al.

(10) Patent No.: US 7,018,974 B2
(45) Date of Patent: Mar. 28, 2006

(54) CLEAR OR TRANSLUCENT AQUEOUS POLYQUATERNARY AMMONIUM FABRIC SOFTENER COMPOSITIONS CONTAINING LOW SOLVENT

(75) Inventors: Gayle Marie Frankenbach, Cincinnati, OH (US); Mark Robert Sivik, Fairfield, OH (US); Ruth Anne Murphy, Cincinnati, OH (US); Ellen Schmidt Baker, Cincinnati, OH (US); Marc Johan Declercq, Strombeek-Bever (BE); Hugo Jean Marie Demeyere, Merchtem (BE); Toan Trinh, Maineville, OH (US); Errol Hoffman Wahl, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 12 days.

(21) Appl. No.: 10/942,592

(22) Filed: Sep. 16, 2004

(65) Prior Publication Data

US 2005/0032669 A1 Feb. 10, 2005

Related U.S. Application Data

(63) Continuation of application No. 09/980,797, filed as application No. PCT/US00/18350 on Jul. 5, 2000, now Pat. No. 6,884,767.

(60) Provisional application No. 60/142,469, filed on Jul. 6, 1999.

(51) Int. Cl.
*C11D 1/835* (2006.01)

(52) U.S. Cl. ..... 510/504

(58) Field of Classification Search ..... 510/522, 510/527

See application file for complete search history.

(56) References Cited

U.S. PATENT DOCUMENTS

| | | | | |
|---|---|---|---|---|
| 4,772,425 | A | 9/1988 | Chirash et al. | |
| 5,205,960 | A | 4/1993 | Kristopeit et al. | |
| 5,670,472 | A | 9/1997 | Keys | |
| 6,211,139 | B1 * | 4/2001 | Keys et al. | 510/504 |

FOREIGN PATENT DOCUMENTS

| | | |
|---|---|---|
| EP | 0 503 155 A1 | 9/1992 |
| EP | 0 803 498 A1 | 10/1997 |
| FR | 2 523 606 | 3/1983 |
| GB | 1 550 205 | 8/1979 |
| WO | WO 99/27050 A1 | 6/1999 |

* cited by examiner

*Primary Examiner*—John R. Hardee
(74) *Attorney, Agent, or Firm*—David V. Upite

(57) ABSTRACT

Clear/translucent formulations comprise polyquaternary ammonium actives with lower, or no, solvent levels except the solvent which is normally present in the polyquaternary raw material stocks by choosing highly efficient principal solvents within a specific Clog P range, employing higher levels of polyquaternary ammonium actives, and/or augmenting the bilayer with surfactants and/or polar oils. Compositions with lowered solvent levels have at or below about 5% by volume of secondary dispersed phases, preferably below about 3% by volume of secondary dispersed phases, and more preferably below about 1% by volume of secondary dispersed phases. The most preferred compositions are essentially free of secondary dispersed phases. High-speed centrifugation easily and quickly reveals the % volume of secondary phase(s).

7 Claims, No Drawings

CLEAR OR TRANSLUCENT AQUEOUS POLYQUATERNARY AMMONIUM FABRIC SOFTENER COMPOSITIONS CONTAINING LOW SOLVENT

CROSS REFERENCE TO RELATED APPLICATION

This application as a continuation of U.S. application Ser. No. 09/980,797, filed Dec. 3, 2001, now U.S. Pat. No. 6,884,767 which is a 371 of PCT /US00/18350 filed Jul. 5, 2000 which claims benefit of U.S. provisional application 60/42469 filed Jul. 6, 1999 the disclosure of which is incorporated by reference.

TECHNICAL FIELD

The present invention relates to specific clear or translucent fabric softener compositions. It has been demonstrated extensively in the patent literature that clear formulations of mono-quaternary or polyquaternary ammonium fabric softener actives can be achieved using high levels of organic solvents. However, formulations with high levels of organic solvents are costly, so it is desirable to formulate quaternary ammonium or polyquaternary ammonium fabric softener actives with lower levels of organic solvent.

BACKGROUND OF THE INVENTION

Much of the previous art related to concentrated clear compositions containing ester and/or amide linked fabric softening actives and specific principal solvents relates to the formulation of mono-quaternary ammonium fabric softener actives and these are disclosed in U.S. Pat. No. 5,759,990, issued Jun. 2, 1998 in the names of E. H. Wahl, H. B. Tordil, T. Trinh, E. R. Carr, R. O. Keys, and L. M. Meyer, for Concentrated Fabric Softening Composition With Good Freeze/Thaw Recovery and Highly Unsaturated Fabric Softener Compound Therefor, and in U.S. Pat. No. 5,747,443, issued May 5, 1998 in the names of Wahl, Trinh, Gosselink, Letton, and Sivik for Fabric Softening Compound/Composition, said patents being incorporated herein by reference. The fabric softener actives in said patents are preferably biodegradable ester-linked materials, containing, long hydrophobic groups with unsaturated chains. Similar clear liquid fabric softening compositions are described in WO 97/03169, incorporated herein by reference, which describes the formulation of liquid fabric softening compositions using said specific principal solvents.

European Patent Application EP 0,803,498, A1, Robert O. Keys and Floyd E. Friedli, filed Apr. 25, 1997 teaches that polyquaternary ammonium actives can be formulated into clear compositions. This application exemplifies clear compositions of polyquaternary actives at high principal solvent levels, typically 15% or more. It is economically desirable to formulate compositions with lower solvent levels, but formulating stable, isotropic, single-phase products at solvent levels at or below about 10%, particularly when using less preferred principal solvent systems is difficult.

SUMMARY OF THE INVENTION

This application discloses surprising approaches used to create clear/translucent aqueous formulations comprising polyquaternary ammonium active in continuous bilayer with lower solvent levels and very surprisingly, even some formulations with no solvent added except the solvent which is normally present in the polyquaternary ammonium active raw material stocks. Approaches to lowering solvent levels including choosing highly efficient principal solvents within a specific Clog P range, employing higher levels of polyquaternary, and/or augmenting the bilayer with surfactants and/or polar oils.

Compositions with lowered solvent levels often contain a certain percentage of phase(s) other than the desired isotropic phase. Often, but not necessarily, these secondary phases are liquid crystalline, because, often, but not necessarily, the desirable isotropic phase shares a phase boundary with the liquid crystalline phase. The % volume of the secondary phase(s) present is an indicator of the degree of product stability. The smaller the % volume of secondary phase(s) the more likely it is that these secondary phases will remain dispersed within the desirable isotropic phase. When the % volume of the dispersed phase becomes too large, compositions tend to separate into layers, and thus stability and homogeneous product performance are lost. When the secondary phase separates, the line of demarcation between the two phases is usually apparent, because the specific density of the phases is often different. Also, the secondary phase is often composed of liquid crystal which can be identified by its birefringent optical properties as shown in *The Aqueous Phase Chemistry of*, Robert Laughlin Preferred compositions have at or below about 5% by volume of secondary dispersed phases, more preferred compositions have below about 3% by volume of secondary dispersed phases, even more preferred compositions have below about 1% by volume of secondary dispersed phases, and the most preferred compositions are essentially free of secondary dispersed phases. High-speed ultra-centrifugation is used to determine the % volume of secondary phase(s).

The clear, or translucent aqueous liquid fabric softener compositions herein comprise:

A. typically, a lower limit of at least about 1%, preferably at least about 5%, more preferably at least about 15%, and most preferably at least about 19% and typically an upper limit of equal to or below about 80%, preferably below about 75%, more preferably below about 70%, and most preferably below about 65%, by weight of the composition, of polyquaternary ammonium fabric softener active, relatively biodegradable fabric softener actives being preferred, as disclosed hereinafter. The phase transition temperature of the softener active or mixture of actives, containing less than 5% organic solvent or water, is preferably less than 50° C., more preferably less than about 35° C., even more preferably less than about 20° C., and yet even more preferably less than about 10° C., or has no significant endothermic phase transition in the region −50° C. to 100° C., as measured by differential scanning calorimetry as disclosed hereinafter.

B. The composition also comprises stabilizer for the composition selected from the group of organic solvents, bilayer modifiers, and mixtures thereof:

(1) an effective level of organic solvent with the organic solvent being preferably chosen from the group of principal solvents or mixtures of principal solvents especially when solvent is employed in the absence of a bilayer modifier and with the principal solvent preferably having a ClogP of from about −2.0 to about 2.6, more preferably from about −1.7 to about 1.6, and even more preferably from about −1.0 to about 1.0, as defined hereinafter, typically used at levels where the lower limit is set at or above about 0.25%, preferably at or above 0.5%, more preferably at or above about 1% and even more preferably at or above 1.5% by weight of the composition and the upper limit is set at or below about 13.5%, preferably at or below about 10%, more preferably at or below about 7.5%, and even more preferably at or below about 5% by weight of the composition.

(2) an effective level of bilayer modifier having lower limits typically set at levels of at or above about 0.25%, preferably at or above about 0.5%, more preferably at or above about 1%, even more preferably at or above about 2.5% by weight of the composition and with higher limits typically set at levels at or below about 20%, preferably at or below about 15%, more preferably at or below about 12%, even more preferably, at or below about 10% and still more preferably at or below about 8% and most preferably at or below about 7.5% by weight of the composition.

(3) mixtures of organic solvent and bilayer modifier; and

C. the balance water.

The clear, or translucent liquid fabric softener compositions can optionally also contain:

(a) optionally, but preferably, from 0% to about 15%, more preferably from about 0.1% to about 8%, and even more preferably from about 0.2% to about 5%, of perfume;

(b) optionally, additional fabric softener actives and/or cationic charge boosters;

(c) other optional ingredients such as brighteners, chemical stabilizers, soil release agents, bactericides, chelating agents, silicones, color care agents; fabric abrasion reducing polymer; malodor control agents and/or;

(d) mixtures thereof.

Preferably, the compositions herein are aqueous, translucent or clear, preferably clear, compositions containing from about 10%, preferably from about 20%, more preferably from about 30%, and even more preferably from about 40%, up to about 95%, preferably up to about 80%, more preferably up to about 70%, and most preferably up to about 60%, by weight of the composition, of water. As discussed before, clear, or translucent liquid compositions comprising polyquaternary ammonium fabric softener actives are preferably prepared such that the compositions have good stability as measured by the presence of 5% or less dispersed phase by volume after centrifuging. Preferably the compositions herein contain less than about 5% of dispersed phase volume, more preferably less than about 3% of dispersed phase volume and even more preferably less than about 1% dispersed phase volume, and most preferably, are essentially free of dispersed phase volume after high speed centrifugation for 16 hours.

The pH of the compositions, especially those containing the preferred softener actives comprising an ester linkage, should be from about 1 to about 5, preferably from about 2 to about 4, and more preferably from about 2.7 to about 3.5.

DETAILED DESCRIPTION OF THE INVENTION

A. Polyquaternary Ammonium Fabric Softener Actives

Typical levels of incorporation of the polyquaternary ammonium fabric softening compound (active) in the softening composition are of from about 1% to about 80% by weight, preferably from about 5% to about 75%, more preferably from about 15% to about 70%, and even more preferably from about 19% to about 65%, by weight of the composition, and preferably is biodegradable as disclosed hereinafter.

When formulating clear products it is advantageous to raise the level of the polyquaternary ammonium active, as this aids in achieving a clear product with lower solvent levels. As has been previously disclosed in U.S. Pat. No. 5,759,990, issued Jun. 2, 1998 in the names of E. H. Wahl, H. B. Tordil, T. Trinh, E. R. Carr, R. O. Keys, and L. M. Meyer, for Concentrated Fabric Softening Composition with Good Freeze/Thaw Recovery and Highly Unsaturated Fabric Softener Compound Therefor, and in U.S. Pat. No. 5,747,443, issued May 5, 1998 in the names of Wahl, Trinh, Gosselink, Letton, and Sivik for Fabric Softening Compound/Composition, both patents being incorporated by reference, it has been found that softener actives with alkyl chains that are unsaturated and/or branched are particularly well suited for use in clear or translucent aqueous fabric softener compositions. An indicator of the suitability of softener actives for use in the compositions of this invention is the phase transition temperature. Preferably, the phase transition temperature of the softener active or mixture of actives, containing less than about 5% organic solvent or water, is less than about 50° C., more preferably less than about 35° C., even more preferably less than about 20° C., and yet even more preferably less than about 10° C., or has no significant endothermic phase transition in the region from about −50° C. to about 100° C.

The phase transition temperature can be measured with a Mettler TA 3000 differential scanning calorimeter with Mettler TC 10A Processor.

Suitable polycationic softener compounds can be found in the art including:

European Patent Application EP 0,803,498, A1, Robert O. Keys and Floyd E. Friedli, filed Apr. 25, 1997;

British Pat. 808,265, issued Jan. 28, 1956 to Arnold Hoffman & Co., Incorporated;

British Pat. 1,161,552, Koebner and Potts, issued Aug. 13, 1969;

DE 4,203,489 A1, Henkel, published Aug. 12, 1993;

EP 0,221,855, Topfl, Heinz, and Jorg, issued Nov. 3, 1986;

EP 0,503,155, Rewo, issued Dec. 20, 1991;

EP 0,507,003, Rewo, issued Dec. 20, 1991

EPA 0,803,498, published Oct. 29, 1997;

French Pat. 2,523,606, Marie-Helene Fraikin, Alan Dillarstone, and Marc Couterau, filed Mar. 22, 1983;

Japanese Pat. 84-273918, Terumi Kawai and Hiroshi Kitamura, 1986;

Japanese Pat. 2-011,545, issued to Kao Corp., Jan. 16, 1990;

U.S. Pat. No. 3,079,436, Hwa, issued Feb. 26, 1963;

U.S. Pat. No. 4,418,054, Green et al., issued Nov. 29, 1983;

U.S. Pat. No. 4,721,512, Topfl, Abel, and Binz, issued Jan. 26, 1988;

U.S. Pat. No. 4,728,337, Abel, Topfl, and Riehen, issued Mar. 1, 1988;

U.S. Pat. No. 4,906,413, Topfl and Binz, issued Mar. 6, 1990;

U.S. Pat. No. 5,194,667, Oxenrider et al., issued Mar. 16, 1993;

U.S. Pat. No. 5,235,082, Hill and Snow, issued Aug. 10, 1993;

U.S. Pat. No. 5,670,472, Keys, issued Sep. 23, 1997;

Weirong Miao, Wei Hou, Lie Chen, and Zongshi Li, Studies on Multifunctional Finishing Agents, Riyong Huaxue Gonye, No. 2, pp. 8–10, 1992;

Yokagaku, Vol 41, No. 4 (1992); and

Disinfection, Sterilization, and Preservation, 4$^{th}$ Edition, published 1991 by Lea & Febiger, Chapter 13, pp. 226–30. All of these references are incorporated herein, in their entirety, by reference.

The fabric softening active portion of the composition can also comprise other cationic, nonionic, and/or amphoteric fabric softening compounds as disclosed hereinafter.

B. Stabilizing System

The stabilizing systems herein comprises solvent and/or bilayer modifier as described hereinafter.

(1) Organic/Principal Solvent

In compositions employing the bilayer modifier as part of the stabilization system, a wide range of organic solvents are effective including a broad range of solvents that have been characterized heretofore as "principal solvents" that fall within the broadest Clog P limits used as part of the definition of such principal solvents. However, in compositions without bilayer modifiers it is preferred to use principal solvents within the more preferred Clog P ranges as defined herein to reduce solvent level while maintaining stability. Modifications of the ClogP ranges can be achieved by adding electrolyte and/or phase stabilizers as taught in copending U.S. Ser. No. 09/309,128, filed May 10, 1999 by Frankenbach, et al. However, when polyquaternary ammonium fabric softening actives are used, inorganic salts are preferably kept at a low level, e.g., less than about 10%, more preferably less than about 5%, and even more preferably less than about 2%, by weight of the composition.

Compositions based on fabric softener actives containing at least some components with multiple hydrophobic chains often comprise a lipid bilayer. Not to be bound by theory, but a certain level and packing geometry of amphiphilic material(s) are necessary to construct a bilayer of appropriate fluidity and curvature to achieve clear or translucent compositions. Solvents, especially principal solvent, and most especially principal solvents in more preferred Clog P ranges, are effective amphiphiles and fill in bilayer space when there is not enough fabric softener active to fill this space. This is believed to be the basis for the surprising result that solvent levels required are actually less as the polyquaternary ammonium level is raised. This result is illustrated in Table 1, hereinafter, by comparing examples 1, 2, and 5 as well as comparing example 3 and 7.

The organic solvent and/or principal solvent and/or mixtures thereof are used at effective levels with the lower limits typically set at or above about 0.25%, preferably at or above about 0.5%, more preferably at or above about 1%, and most preferably at or above about 1.5% by weight of the composition and with higher limits typically set at levels at or below about 13.5%, preferably at or below about 10%, more preferably at or below about 7.5%, and even more preferably, at or below about 5% by weight of the composition.

An advantage of the bilayer modifiers disclosed herein is that lower levels of principal solvents and/or a wider range of organic and/or principal solvents can be used to provide clarity. E.g., without bilayer modifier, the ClogP of the principal solvent system as disclosed hereinafter would typically be limited to a range of from about 0.15 to about 0.64 as disclosed in said '443 patent. It is known that higher ClogP compounds, up to about 1 can be used when combined with other solvents as disclosed in copending provisional application Ser. No. 60/047,058, filed May 19, 1997 and re-filed PCT/US98/10167 on May 18, 1998, in the names of H. B. Tordil, E. H. Wahl, T. Trinh, M. Okamoto, and D. L. Duval, or with nonionic surfactants, and especially with the phase stabilizers disclosed herein as previously disclosed in Docket No. 7039P, filed Mar. 2, 1998, Provisional Application Ser. No. 60/076,564, and re-filed as, the inventors being D. L. DuVal, G. M. Frankenbach, E. H. Wahl, T. Trinh, H. J. M. Demeyere, J. H. Shaw and M. Nogami. Title: Concentrated, Stable, Translucent or Clear Fabric Softening Compositions, both of said applications being incorporated herein by reference. With the bilayer modifier present, the level of principal solvent can be less and/or the ClogP range that is usable is broadened to include from about −2.0 to about 2.6, more preferably from about −1.7 to about 1.6, and even more preferably from about −1.0 to about 1.0.

With the bilayer modifier present, levels of principal solvent that are substantially less than about 10% by weight of the composition can be used, which is preferred for odor, safety and economy reasons. The bilayer modifier as defined hereinafter, in combination with a very low level of principal solvent is sufficient to provide good clarity and/or stability of the composition. In preferred compositions, the level of principal solvent is insufficient to provide the required degree of clarity and/or stability and the addition of the bilayer modifier provides the desired clarity/stability. Said bilayer modifier can be used to either make a composition translucent or clear, or can be used to increase the temperature range at which the composition is translucent or clear.

Thus one can use the principal solvent, at the previously indicated levels, in a method in which the said principal solvent is added to a composition that is not translucent, or clear, or which has a temperature where phase instability occurs that is too high, to make the composition translucent or clear, or, when the composition is clear, e.g., at ambient temperature, or down to a specific temperature, to reduce the temperature at which phase instability occurs, preferably by at least about 5° C., more preferably by at least about 10° C. The principal solvent is efficient in that it provides the maximum advantage for a given weight of solvent. It is understood that "solvent", as used herein, refers to the effect of the principal solvent and not to its physical form at a given temperature, since some of the principal solvents are solids at ambient temperature.

Principal solvents that can be present are selected to minimize solvent odor impact in the composition and to provide a low viscosity to the final composition. For example, isopropyl alcohol is flammable and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 50° F. (about 10° C.), more preferably down to about 40° F. (about 4.4° C.) and are able to recover after storage down to about 20° F. (about 6.7° C.).

Other suitable solvents can be selected based upon their octanol/water partition coefficient (P). Octanol/water partition coefficient of a solvent is the ratio between its equilibrium concentration in octanol and in water. The partition coefficients of the solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.—Chim. Theor., 19, 71 (1984).

The principal solvents herein are selected from those having a ClogP of from −2.0 to 2.6, preferably from −1.7 to 1.6, and more preferably from −1.0 to 1.0., The most preferred solvents can be identified by the appearance of the diluted fabric treatment compositions. These diluted compositions comprise vesicular dispersions of fabric softener which contain on average more uni-lamellar vesicles than conventional fabric softener compositions, which contain predominantly multilamellar vesicles. The larger the proportion of uni-lamellar vs. multilamellar vesicles, the better the compositions seem to perform. These compositions provide surprisingly good fabric softening as compared to similar compositions prepared in the conventional way with the same fabric softener active.

Operable solvents have been disclosed, listed under various listings, e.g., aliphatic and/or alicyclic diols with a given number of carbon atoms; monols; derivatives of glycerine; alkoxylates of diols; and mixtures of all of the above can be found in said U.S. Pat. Nos. 5,759,990 and 5,747,443 and PCT application WO 97/03169 published on 30 Jan. 1997, said patents and application being incorporated herein by reference, the most pertinent disclosure appearing at pages 24–82 and 94–108 (methods of preparation) of the said WO 97/03169 specification and in columns 11–54 and 66–78 (methods of preparation) of the '443 patent. The '443 and PCT disclosures contain reference numbers to the Chemical Abstracts Service Registry numbers (CAS No.) for those compounds that have such a number and the other compounds have a method described, that can be used to prepare the compounds. Some inoperable solvents listed in the '443 disclosure can be used in mixtures with operable solvents and/or with the high electrolyte levels and/or phase stabilizers, to make concentrated fabric softener compositions that meet the stability/clarity requirements set forth herein.

Many diol solvents that have the same chemical formula can exist as many stereoisomers and/or optical isomers. Each isomer is normally assigned with a different CAS No. For examples, different isomers of 4-methyl-2,3-hexanediol are assigned to at least the following CAS Nos: 146452-51-9; 146452-50-8; 146452-49-5; 146452-48-4; 123807-34-1; 123807-33-0; 123807-32-9; and 123807-31-8.

In the '443 and PCT specifications, each chemical formula is listed with only one CAS No. This disclosure is only for exemplification and is sufficient to allow the practice of the invention. The disclosure is not limiting. Therefore, it is understood that other isomers with other CAS Nos, and their mixtures, are also included. By the same token, when a CAS No. represents a molecule which contains some particular isotopes, e.g., deuterium, tritium, carbon-13, etc., it is understood that materials which contain naturally distributed isotopes are also included, and vice versa.

There is a clear similarity between the acceptability (formulatability) of a saturated diol and its unsaturated homologs, or analogs, having higher molecular weights. The unsaturated homologs/analogs have the same formulatability as the parent saturated solvent with the condition that the unsaturated solvents have one additional methylene (viz., $CH_2$) group for each double bond in the chemical formula. In other words, there is an apparent "addition rule" in that for each good saturated solvent of this invention, which is suitable for the formulation of clear, concentrated fabric softener compositions, there are suitable unsaturated solvents where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant with respect to the chemical formula of the "parent" saturated solvent. This is due to a surprising fact that adding a —$CH_2$— group to a solvent chemical formula has an effect of increasing its ClogP value by about 0.53, while removing two adjacent hydrogen atoms to form a double bond has an effect of decreasing its ClogP value by about a similar amount, viz., about 0.48, thus about compensating for the —$CH_2$— addition. Therefore one goes from a preferred saturated solvent to the preferred higher molecular weight unsaturated analogs/homologs containing at least one more carbon atom by inserting one double bond for each additional $CH_2$ group, and thus the total number of hydrogen atoms is kept the same as in the parent saturated solvent, as long as the ClogP value of the new solvent remains within the effective range. The following are some illustrative examples:

It is possible to substitute for part of the principal solvent mixture a secondary solvent, or a mixture of secondary solvents, which by themselves are not operable as a principal solvent of this invention, as long as an effective amount of the operable principal solvents of this invention is still present in the liquid concentrated, clear fabric softener composition. An effective amount of the principal solvents of this invention is at least greater than about 1%, preferably more than about 3%, more preferably more than about 5% of the composition, when at least about 15% of the softener active is also present.

Principal solvents preferred for improved clarity at 50° F. are 2-ethyl-1,3-hexanediol, 1,2-hexanediol; 1,2-pentanediol; hexylene glycol; 1,2-butanediol; 1,4-cyclohexanediol; pinacol; 1,5-hexanediol; 1,6-hexanediol; and/or 2,4-dimethyl-2,4-pentanediol.

(2). Bilayer Modifiers

Bilayer modifiers are compounds that allow the formation of stable formulations at lower and substantially reduced solvent levels even to the point of, surprisingly, eliminating solvent in some compositions. Bilayer modifiers are chose form the group of 1) mono-alkyl cationic amine compounds, 2) polar and non-polar hydrophobic oils, 3) nonionic surfactants, and 4) mixtures thereof.

Fabric softening actives, especially those actives or compositions comprising multiple hydrophobes tend to form bilayers. Not to be bound by theory but, when these bilayers and the water between the bilayers are sufficiently flexible, the composition can become a single-phase isotropic system comprising a bicontinuous bilayer or sponge phase.

Not to be bound by theory but, there are many ways to improve flexibility such that single-phase isotropic bicontinuous systems with improved stability are achieved. Using fabric softening actives with low phase transition temperatures enhances flexibility of the bilayer since the actives are fluid. The phase transition temperature can be lowered by several means, for instance by incorporating branching and/or unsaturation in the hydrophobe of fabric softener actives and employing mixtures of fabric softener actives. Using principal solvents, particularly those within the most preferred Clog P ranges enhances the flexibility of both the water and the bilayer because these principal solvents, especially in the more preferred ranges, have the ability to migrate between the water where they can break up the water hydrogen bond structure and the bilayer interface where they can promote net zero curvature at the bilayer interface. Not to be bound by theory but, net zero curvature is more readily achieved when the head group of an amphiphile (or group of amphiphiles) and the tail moiety of a amphiphile (or group of amphiphiles ) occupy equal or nearly equal volume areas. When the head group and tail moiety area volumes are nearly equal, there is no driving force to cause the surfactant interface to curve in either direction and then the surfactant interface becomes bicontinuous (*Surfactants and Interfacial Phenomena,* $2^{nd}$, M. J. Rosen). Often cosurfactants are used to make oil in water bicontinuous micro-emulsions (*Surfactants and Interfacial Phenomena,* $2^{nd}$, M. J. Rosen). A similar principle operates with fabric softener bilayers. Diquats, by their very nature have large head groups because the two charged amine moieties are both very water miscible and therefore, it is helpful to have a principal solvent that can migrate to the interface acting to 'fill in' for the tail volume, to achieve zero curvature necessary to drive the system into the isotropic bicontinuous phase. Bilayer modifiers can also act as 'fillers' that together with the fabric softener active push the system into a state of zero curvature necessary to drive the system into the isotropic bicontinuous phase. With the appropriate bilayer modifier, the principal solvent or organic solvent can be substantially reduced even to the point, in some cases, of surprisingly eliminating the need to add solvent that is not a part of the polyquaternary, preferably diquaternary, ammonium fabric softening active raw material because the solvent is only necessary to break the water structure and no longer necessary to act as a filler at the fabric softener bilayer surface. Unsaturation and/or branching in the components improves flexibility, thus facilitating the bending of the surface of the bilayer, when necessary.

Bilayer modifiers are highly desired optional components of clear compositions with low solvent or zero added solvent. Preferably these compounds are amphiphilic with a water miscible head group attached to a hydrophobic moiety. When bilayer modifiers are added they are incorporated at effective levels having lower limits typically set at levels of at or above about 0.25%, preferably at or above about 0.5%, more preferably at or above about 1%, even more preferably at or above about 2.5% by weight of the composition and with higher limits typically set at levels at or below about 20%, preferably at or below about 15%, more preferably at or below about 12%, even more preferably, at or below about 10% and still more preferably at or below about 8% and most preferably at or below about 7.5% by weight of the composition.

Suitable bilayer modifiers include:

(1) Mono-Alkyl Cationic Amine Compounds

One of the more preferred classes of bilayer modifiers includes mono-alkyl cationic amine compounds and especially the preferred mono-alkyl quaternary ammonium compounds. Preferably, the phase transition temperature of the mono-alkyl cationic amine, or the mixture of mono-alkyl cationic amines, containing less than about 5% organic solvent or water, is less than about 50° C., more preferably less than about 35° C., even more preferably less than about 20° C., and yet even more preferably less than about 10° C., or has no significant endothermic phase transition in the region from about −50° C. to about 100° C. These generally include mono-alkyl cationic amine compounds having hydrophobes derived from saturated and/or unsaturated primary, secondary, and/or branched hydrocarbons, or mixtures of such amines having a broad distribution of hydrophobe lengths to lower phase transition temperatures. The phase transition temperature can be measured with a Mettler TA 3000 differential scanning calorimeter with Mettler TC 10A Processor.

Mono-alkyl cationic amine compounds useful in the present invention are, preferably, cationic amine salts of the general formula:

$$[R^4N^+(R^5)_3]A^-$$

wherein:

$R^4$ is $C_8$–$C_{22}$ alkyl or alkenyl group, preferably $C_{10}$–$C_{18}$ alkyl or alkenyl group, or mixtures of these groups;

each $R^5$ is hydrogen or $C_1$–$C_6$ alkyl or substituted alkyl group (e.g., hydroxy alkyl or an alkyl group with a carboxylate moiety, or an alkyl group with a sulfonate or sulfate moiety attached), preferably $C_1$–$C_3$ alkyl group, e.g., methyl (most preferred), ethyl, propyl, and the like, benzyl group, polyethoxylated chain with from about 2 to about 50 oxyethylene units, preferably from about 2.5 to about 20 oxyethylene units, more preferably from about 3 to about 10 oxyethylene units, and/or mixtures thereof; and $A^-$ is fabric softener compatible counterion. When the mono-alkyl cationic amine derives its cationic charge from protonation (e.g. one or more of each $R^5$ is a hydrogen) these compounds can be added to the composition as either the protonated or free amine with the assumption that the free amine will become cationic at the preferred low pH's for these compositions.

An especially preferred example, of mono-alkyl cationic amine compound particularly for use as a bilayer modifier, is a cocoalkyl trimethylammonium chloride available from Witco under the trade name Adogen 461. Other examples for mono-alkyl cationic amine compounds are monolauryl trimethyl ammonium chloride and monotallow trimethyl ammonium chloride available from Witco under the trade name Varisoft® 471 and monooleyl trimethyl ammonium chloride available from Witco under the tradename Varisoft® 417. Amphoterics such as Armeen® Z from Akzo Nobel can also be used.

The $R^4$ group can also be attached to the cationic nitrogen atom through a group containing one, or more, ester, amide, ether, amine, etc., linking groups. Such linking groups are preferably within from about one to about three carbon atoms of the nitrogen atom.

Mono-alkyl cationic amine compounds also include $C_8$–$C_{22}$ alkyl choline esters. The preferred compounds of this type have the formula:

$$[R^1X\text{–}YN^+(R)_3]A^-$$

wherein $R^1$ is $C_8$–$C_{22}$ alkyl or alkenyl group, preferably $C_{10}$–$C_{18}$ alkyl or alkenyl group, or mixtures of these groups; X is a linking group containing heteroatoms (e.g. oxygen, nitrogen, sulfur) with some nonlimititng linking groups including ethers, esters, and amides with esters being a preferred linking group; Y is a hydrocarbon based linking group containing about 0 to about 4 carbons. R is hydrogen or $C^1$–$C_6$ alkyl or substituted alkyl group (e.g;, hydroxy alkyl or an alkyl group with a carboxylate moiety, or an alkyl group with a sulfonate or sulfate moiety attached), preferably $C_1$–$C_3$ alkyl group, e.g., methyl (most preferred), ethyl, propyl, and the like, benzyl group, polyethoxylated chain with from about 2 to about 50 oxyethylene units, preferably from about 2.5 to about 20 oxyethylene units, more preferably from about 3 to about 10 oxyethylene units, and/or mixtures thereof; and $A^-$ is fabric softener compatible counterion for example, but not limited to $Cl^-$ or methyl sulfate.

Highly preferred compounds include $C_{12}$–$C_{14}$ coco choline ester and $C_{16}$–$C_{18}$ tallow choline ester.

Suitable biodegradable single-long-chain alkyl compounds containing an ester linkage in the long chains are described in U.S. Pat. No. 4,840,738, Hardy and Walley, issued Jun. 20, 1989, said patent being incorporated herein by reference.

Suitable mono-long chain materials correspond to the preferred biodegradable softener actives disclosed above, where only one $R^1$ group is present in the molecule. The $R^1$ group or $YR^1$ group, is replaced normally by an R group.

Mono-alkyl quaternary compounds are also useful as softness performance boosters, charge booster, and they scavenge anionic surfactant in the rinse. These quaternary compounds having only a single long alkyl chain, can protect the cationic softener from interacting with anionic surfactants and/or detergent builders that are carried over into the rinse from the wash solution. It is highly desirable to have sufficient single long chain quaternary compound, or cationic polymer to tie up the anionic surfactant. This provides improved softness and wrinkle control.

When the mono-long chain alkyl cationic amine compound is present, to boost softness performance, its levels should also be consistent with, and effective for, achieving a clear, stable formulation.

(2) Polar and Non-Polar Hydrophobic Oils

Polar hydrophobic oils are suitable as bilayer modifiers. An especially preferred, class of polar oils includes substituted, e.g., esterified, and/or non-substituted carboxylic acids, especially dicarboxylic acids. Nonlimiting examples from this class include dioctyl adipate available from Alzo Inc. under the trade name Wickenol® 158, dioctyl succinate available from Alzo Inc. under the trade name Wickenol® 159, and oleyl oleate available from Alzo Inc. under the trade name Dermol® OLO. Other useful polar oils can be selected from emollients such as fatty esters, e.g. methyl oleates, Wickenols®, derivatives of myristic acid such as isopropyl myristate, and triglycerides such as canola oil; free fatty acids such as those derived from canola oils, fatty alcohols such as oleyl alcohol, bulky esters such as benzyl benzoate and benzyl salicylate, diethyl or dibutyl phthalate; bulky alcohols or diols; and perfume oils particularly low-odor perfume oils such as linalool; mono or poly sorbitan esters; and/or mixtures thereof. Non-polar hydrophobic oils can be selected from petroleum derived oils such as hexane, decane, pentadecane, dodecane, isopropyl citrate and perfume bulky oils such as limonene, and/or mixtures thereof. In particular, the free fatty acids such as partially hardened canola oil can provide increased softness benefits.

(3) Nonionic Surfactants

Nonionic surfactants are also useful as bilayer modifiers and preferred bilayer modifiers within this group, are nonionic surfactants containing amine or amide moieties, with ethoxylated amides being especially preferred. Nonionic surfactants derived from saturated and/or unsaturated primary, secondary, and/or branched, amine, amide, amine-oxide, fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with ≦50, preferably ≦30, more preferably from about 5 to about 15, and even more preferably from about 6 to about 12, ethylene oxide moieties to provide an HLB of from about 8 to about 20, preferably from about 10 to about 18, and more preferably from about 11 to about 15 are useful as bilayer modifiers.

Nonionic surfactants suitable as bilayer modifiers can be selected from the set of nonlimiting classes below:

(a)—Alkyl Amide Alkoxylated Nonionic Surfactants

Suitable surfactants have the formula:

$$R—C(O)—N(R^4)_n—[(R^1O)_x(R^2O)_yR^3]_m$$

wherein R is $C_{7-21}$ linear alkyl, $C_{7-21}$ branched alkyl, $C_{7-21}$ linear alkenyl, $C_{7-21}$ branched alkenyl, and/or mixtures thereof. Preferably R is $C_{8-18}$ linear alkyl or alkenyl.

$R^1$ is —$CH_2$—$CH_2$—, $R^2$ is $C_3$–$C_4$ linear alkyl, $C_3$–$C_4$ branched alkyl, and/or mixtures thereof; preferably $R^2$ is —$CH(CH_3)$—$CH_2$—. Surfactants which comprise a mixture of $R^1$ and $R^2$ units preferably comprise from about 4 to about 12 —$CH_2$—$CH_2$— units in combination with from about 1 to about 4 —$CH(CH_3)$—$CH_2$— units. The units can be alternating or grouped together in any combination suitable to the formulator. Preferably the ratio of $R^1$ units to $R^2$ units is from about 4:1 to about 8:1. Preferably an $R^2$ unit (i.e. —$C(CH_3)H$—$CH_2$—) is attached to the nitrogen atom followed by the balance of the chain comprising from about 4 to 8 —$CH_2$—$CH_2$— units.

$R^3$ is hydrogen, $C_1$–$C_4$ linear alkyl, $C_3$–$C_4$ branched alkyl, and/or mixtures thereof; preferably hydrogen or methyl, more preferably hydrogen.

$R^4$ is hydrogen, $C_1$–$C_4$ linear alkyl, $C_3$–$C_4$ branched alkyl, and/or mixtures thereof; preferably hydrogen. When the index m is equal to 2 the index n must be equal to 0 and the $R^4$ unit is absent.

The index m is 1 or 2, the index n is 0 or 1, provided that m+n equals 2; preferably m is equal to 1 and n is equal to 1, resulting in one —$[(R^1O)_x(R^2O)_yR^3]$ unit and R4 being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all the alkyleneoxy units are ethyleneoxy units.

Examples of suitable ethoxylated alkyl amide surfactants are Rewopal® $C_6$ from Witco, Amidox® C5 from Stepan, and Ethomid® O/17 and Ethomid® HT/60 from Akzo.

(b)—Alkyl or Alkyl-aryl Nonionic Alkoxylated Surfactants

Suitable alkyl alkoxylated nonionic surfactants with amine functionality are generally derived from saturated or unsaturated, primary, secondary, and branched fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having ≦ about 50 moles alkylene oxide moieties (e.g. ethylene oxide and/or propylene oxide) per mole of amine. The amine or amine-oxide surfactants for use herein have at least one hydrophobe with from about 6 to about 22 carbon atoms, and are in either straight chain and/or branched chain configuration, preferably there is one hydrocarbon in a straight chain configuration having about 8 to about 18 carbon atoms with one or two alkylene oxide chains attached to the amine moiety, in average amounts of ≦50 about moles of alkylene oxide per amine moiety, more preferably from about 5 to about 15 moles of alkylene oxide, and most preferably a single alkylene oxide chain on the amine moiety containing from about 8 to about 12 moles of alkylene oxide per amine moiety. Preferred materials of this class also have pour points about 70° F. and/or do not solidify in these clear formulations. Examples of ethoxylated amine surfactants include Berol® 397 and 303 from Rhone Poulenc and Ethomeens® C/20, C25, T/25, S/20, S/25 and Ethodumeens® T/20 and T25 from Akzo.

Suitable alkyl alkoxylated nonionic surfactants are generally derived from saturated or unsaturated primary, secondary, and branched fatty alcohols, fatty acids, alkyl phenols, or alkyl aryl (e.g., benzoic) carboxylic acid, where the active hydrogen(s) is alkoxylated with ≦ about 30 alkylene, preferably ethylene, oxide moieties (e.g. ethylene oxide and/or propylene oxide). These nonionic surfactants for use herein preferably have from about 6 to about 22 carbon atoms on the alkyl or alkenyl chain, and are in either straight chain or branched chain configuration, preferably straight chain configurations having from about 8 to about 18 carbon atoms, with the alkylene oxide being present, preferably at the primary position, in average amounts of ≦ about 30 moles of alkylene oxide per alkyl chain, more preferably from about 5 to about 15 moles of alkylene oxide, and most preferably from about 8 to about 12 moles of alkylene oxide. Preferred materials of this class also have pour points of about 70° F. and/or do not solidify in these clear formulations. Examples of alkyl alkoxylated surfactants with straight chains include Neodol® 91-8, 25-9, 1-9, 25-12, 1-9, and 45-13 from Shell, Plurafac® B-26 and C-17 from BASF, and Brij® 76 and 35 from ICI Surfactants. Examples of branched alkyl alkoxylated surfactants include Tergitol® 15-S-12, 15-S-15, and 15-S-20 from Union Carbide and Emulphogene® BC-720 and BC-840 from GAF. Examples of alkyl-aryl alkoxylated surfactants include Igepal® CO-620 and CO-710, from Rhone Poulenc, Triton® N-111 and N-150 from Union Carbide, Dowfax® 9N5 from Dow and Lutensol® AP9 and AP14, from BASF.

Preferably, the compounds of the alkyl or alkyl-aryl alkoxylated surfactants and alkyl or alkyl-aryl amine and amine-oxide alkoxylated surfactants have the following general formula:

$$R^1{}_m—Y—[(R^2—O)_z—H]_p$$

wherein each $R^1$ is selected from the group consisting of saturated or unsaturated, primary, secondary or branched chain alkyl or alkyl-aryl hydrocarbons; said hydrocarbon chain preferably having a length of from about 6 to about 22, more preferably from about 8 to about 18 carbon atoms, and even more preferably from about 8 to about 15 carbon atoms, preferably, linear and with no aryl moiety; wherein each $R^2$ is selected from the following groups or combinations of the following groups: $—(CH_2)_n—$; wherein about 1<n≦ about 3, preferably from 2–3, more preferably 2; Y is selected from the following groups: —O—; $—N(A)_q—$; —C(O)O—; $—(O←)N(A)_q—$; $—B—R^3—O—$; $—B—R^3—N(A)_q—$; $—B—R^3—C(O)O—$; $—B—R^3—N(→O)(A)—$; and/or mixtures thereof; wherein A is selected from the following groups: H; $R^1$; $—(R^2—O)_z—H$; $—(CH_2)_x CH_3$; phenyl, or substituted aryl, wherein 0≦x≦ about 3 and B is selected from the following groups: —O—; —N(A)—; —C(O)O—; and/or mixtures thereof in which A is as defined above; and wherein each $R^3$ is selected from the following groups: $R^2$; phenyl; or substituted aryl. The terminal hydrogen in each alkoxy chain can be replaced by a short chain $C_{1-4}$ alkyl or acyl group to "cap" the alkoxy chain. z is from about 5 to about 30. p is the number of ethoxylate chains, typically one or two, preferably one and m is the number of hydrophobic chains, typically one or two, preferably one, and q is a number that indicates the number of moieties that completes the structure, usually one.

Preferred structures are those in which m=1, p=1 or 2, and 5≦z≦30, and q can be 1 or 0, but when p=2, q must be 0; more preferred are structures in which m=1, p=1 or 2, and 7 ≦z≦20; and even more preferred are structures in which m=1, p=1 or 2, and 9≦z≦12. The preferred y is 0.

(c)—Alkoxylated and Non-alkoxylated Nonionic Surfactants with Bulky Head Groups

Suitable alkoxylated and non-alkoxylated phase stabilizers with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having ≦ about 50, preferably ≦ about 30, moles per heterocyclic or carbohydrate head group. The hydrocarbon groups on the carbohydrate or heterocyclic surfactant for use herein have from about 6 to about 22 carbon atoms, and are in either straight chain and/or branched chain configuration. Preferably there is one hydrocarbon having from about 8 to about 18 carbon atoms with one or two alkylene oxide chains carbohydrate or heterocyclic moiety with each alkylene oxide chain present in average amounts of ≦ about 50, preferably ≦ about 30, per carbohydrate or heterocyclic moiety, more preferably from about 5 to about 15 moles of alkylene oxide per alkylene oxide chain, and most preferably between about 8 and about 12 moles of alkylene oxide total per surfactant molecule including alkylene oxide on both the hydrocarbon chain and on the heterocyclic or carbohydrate moiety. Examples of phase stabilizers in this class are Tween® 40, 60, and 80 available from ICI Surfactants.

Preferably the compounds of the alkoxylated and non-alkoxylated nonionic surfactants with bulky head groups have the following general formulas:

$$R^1—C(O)—Y'—[C(R^5)]_m—CH_2O(R_2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and/or mixtures thereof; and A is selected from the following groups: H; $R^1$; $—(R^2—O)_z—H$; $—(CH_2)_xCH_3$; phenyl, or substituted aryl, wherein 0≦x≦about 3 and z is from about 5 to about 30; each $R^2$ is selected from the following groups or combinations of the following groups: $—(CH_2)_n—$ and/or $—[CH(CH_3)CH_2]—$; and each $R^5$ is selected from the following groups: —OH; and $—O(R^2O)_z—H$ ; and m is from about 2 to about 4;

Another useful general formula for this class of surfactants is

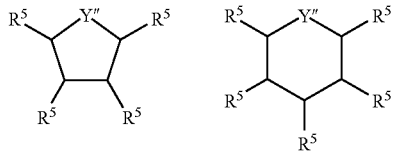

wherein Y"=N or O; and each $R^5$ is selected independently from the following: —H, —OH, —$(CH_2)xCH_3$, —$(OR^2)_z$—H, —$OR^1$, —OC(O)$R^1$, and —$CH_2(CH_2$—$(OR^2)_{z''}$—H)—$CH_2$—$(OR^2)_{z'}$—C(O) $R^1$. With x, $R^1$, and $R^2$ as defined above in section D above and z, z', and z" are all from about 5≦to ≦ about 20, more preferably the total number of z+z'+z" is from about 5≦to ≦about 20. In a particularly preferred form of this structure the heterocyclic ring is a five member ring with Y"=O, one $R^5$ is —H, two $R^5$ are —O—$(R^2O)_z$—H, and at least one $R^5$ has the following structure —$CH(CH_2$—$(OR^2)_{z''}$—H)—$CH_2$—$(OR^2)_{z'}$—OC(O) $R^1$ with the total z+z'+z"=to from about 8≦to ≦about 20 and $R^1$ is a hydrocarbon with from about 8 to about 20 carbon atoms and no aryl group.

Another group of surfactants that can be used are polyhydroxy fatty acid amide surfactants of the formula:

$$R^6—C(O)—N(R^7)—Z$$

wherein: each $R^7$ is H, $C_1$–$C_4$ hydrocarbyl, $C_1$–$C_4$ alkoxyalkyl, or hydroxyalkyl, e.g., 2-hydroxyethyl, 2-hydroxypropyl, etc., preferably $C_1$–$C_4$ alkyl, more preferably $C_1$ or $C_2$ alkyl, most preferably $C_1$ alkyl (i.e., methyl) or methoxyalkyl; and $R^6$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl moiety having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl moiety. Z preferably will be selected from the group consisting of —$CH_2$—$(CHOH)_n$—$CH_2OH$, —$CH(CH_2OH)$—$(CHOH)_n$—$CH_2OH$, —$CH_2$—$(CHOH)_2(CHOR')(CHOH)$—$CH_2OH$, where n is an integer from 3 to 5, inclusive, and R' is H or a cyclic mono- or poly- saccharide, and alkoxylated derivatives thereof. Most preferred are glycityls wherein n is 4, particularly —$CH_2$—$(CHOH)_4$—$CH_2O$. Mixtures of the above Z moieties are desirable.

$R^6$ can be, for example, N-methyl, N-ethyl, N-propyl, N-isopropyl, N-butyl, N-isobutyl, N-2-hydroxyethyl, N-1-methoxypropyl, or N-2-hydroxypropyl.

$R^6$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

(d)—Block Copolymers Obtained by Copolymerization of Ethylene Oxide and Propylene Oxide Suitable polymers include a copolymer having blocks of terephthalate and polyethylene oxide. More specifically, these polymers are comprised of repeating units of ethylene and/or propylene terephthalate and polyethylene oxide terephthalate at a preferred molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymer is in the range of from about 5,000 to about 55,000.

Another preferred polymer is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

Highly preferred polymers have the generic formula:

$$X—(OCH_2CH_2)_n—[O—C(O)—R^1—C(O)—O—R^2)_u —[O—C(O)—R^1—C(O)—O)—(CH_2CH_2O)_n —X \quad (1)$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and/or mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and/or mixtures thereof.

For the $R^1$ moieties, the degree of partial substitution with moieties other than 1,4-phenylene should be such that the desired properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) are adequate. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and/or mixtures thereof. Preferably, the $R^2$ moieties are essentially ethylene moieties, 1,2-propylene moieties or mixture thereof. Inclusion of a greater percentage of 1,2-propylene moieties tends to improve the water solubility of the compounds.

Therefore, the use of 1,2-propylene moieties or a similar branched equivalent is desirable for incorporation of any substantial part of the polymer in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these polymers is contained in European Patent Application 185,427, Gosselink, published Jun. 25, 1986, incorporated herein by reference.

Other preferred copolymers include surfactants, such as the polyoxypropylene/polyoxyethylene/polyoxypropylene (PO/EO/PO) reverse block polymers.

The copolymer can optionally contain propylene oxide in an amount up to about 15% by weight. Other preferred copolymer surfactants can be prepared by the processes described in U.S. Pat. No. 4,223,163, issued Sep. 16, 1980, Builloty, incorporated herein by reference.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Certain of the block polymer surfactant compounds designated PLURONIC® and TETRONIC® by the BASF-Wyandotte Corp., Wyandotte, Mich., are suitable in compositions of the invention.

A particularly preferred copolymer contains from about 40% to about 70% of a polyoxypropylene/polyoxyethylene/polyoxypropylene block polymer blend comprising about 75%, by weight of the blend, of a reverse block copolymer of polyoxyethylene and polyoxypropylene containing 17 moles of ethylene oxide and 44 moles of propylene oxide; and about 25%, by weight of the blend, of a block copolymer of polyoxyethylene and polyoxypropylene initiated with trimethylolpropane and containing 99 moles of propylene oxide and 24 moles of ethylene oxide per mole of trimethylolpropane.

Suitable for use as copolymer are those having relatively high hydrophilic-lipophilic balance (HLB).

Other polymers useful herein include the polyethylene glycols having a molecular weight of from about 950 to about 30,000 which can be obtained from the Dow Chemical Company of Midland, Mich. Such compounds for example, have a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol with the requisite number of moles of ethylene oxide to provide the desired molecular weight and melting point of the respective polyethylene glycol.

Other block copolymers include the polyalkylene oxide polysiloxanes having a dimethyl polysiloxane hydrophobic moiety and one or more hydrophilic polyalkylene side chains, and having the general formula:

$$R^1—(CH_3)_2SiO—[(CH_3)_2SiO]_a—[(CH_3)(R^1)SiO]_b—Si(CH_3)_2—R^1$$

wherein a+b are from about 1 to about 50, preferably from about 3 to about 30, more preferably from about 10 to about 25, and each $R^1$ is the same or different and is selected from the group consisting of methyl and a poly(ethyleneoxide/propyleneoxide) copolymer group having the general formula:

$$—(CH_2)_nO(C_2H_4O)_c(C_3H_6O)_dR^2$$

with at least one $R^1$ being a poly(ethyleneoxy/propyleneoxy) copolymer group, and wherein n is 3 or 4, preferably 3; total c (for all polyalkyleneoxy side groups) has a value of from 1 to about 100, preferably from about 6 to about 100; total d is from 0 to about 14, preferably from 0 to about 3; and more preferably d is 0; total c+d has a value of from about 5 to about 150, preferably from about 9 to about 100 and each $R^2$ is the same or different and is selected from the group consisting of hydrogen, an alkyl having 1 to 4 carbon atoms, and an acetyl group, preferably hydrogen and methyl group. Each polyalkylene oxide polysiloxane has at least one $R^1$ group being a poly(ethyleneoxide/propyleneoxide) copolymer group.

Nonlimiting examples of this type of surfactants are the Silwet® surfactants which are available from CK-Witco are listed below. Representative Silwet surfactants which contain only ethyleneoxy ($C_2H_4O$) groups are as follows.

| Name | Average MW | Average a + b | Average total c |
|---|---|---|---|
| L-7608 | 600 | 1 | 9 |
| L-7607 | 1,000 | 2 | 17 |
| L-77 | 600 | 1 | 9 |
| L-7605 | 6,000 | 20 | 99 |
| L-7604 | 4,000 | 21 | 53 |
| L-7600 | 4,000 | 11 | 68 |
| L-7657 | 5,000 | 20 | 76 |
| L-7602 | 3,000 | 20 | 29 |
| L-7622 | 10,000 | 88 | 75 |

Nonlimiting examples of surfactants which contain both ethyleneoxy ($C_2H_4O$) and propyleneoxy ($C_3H_6O$) groups are as follows.

| Name | Average MW | EO/PO ratio |
|---|---|---|
| Silwet L-720 | 12,000 | 50/50 |
| Silwet L-7001 | 20,000 | 40/60 |
| Silwet L-7002 | 8,000 | 50/50 |
| Silwet L-7210 | 13,000 | 20/80 |
| Silwet L-7200 | 19,000 | 75/25 |
| Silwet L-7220 | 17,000 | 20/80 |

Some nonlimiting preferred Dow Corning® polyethylene oxide polysiloxanes include Dow Corning® 190 Dow Corning® Q2-5211. Other nonlimiting examples of polyethylene oxide polysiloxanes useful in the present invention include the following compounds available from Dow Corning® 193, FF400 Fluid, Q2-5220, Q4-3667, as well as compounds available from Toray Dow Corning Silicone Co., Ltd. know as SH3771C, SH3772C, SH3773C, SH3746, SH3748, SH3749, SH8400, SF8410, and SH8700, KF351 (A), KF352 (A), KF354 (A), and KF615 (A) of Shin-Etsu Chemical Co., Ltd., TSF4440, TSF4445, TSF4446, TSF4452 of Toshiba Silicone Co.

The molecular weight of the polyalkyleneoxy group ($R^1$) is less than or equal to about 10,000. If propyleneoxy groups are present in the polyalkylenoxy chain, they can be distributed randomly in the chain or exist as blocks. Surfactants which contain only propyleneoxy groups without ethyleneoxy groups are not preferred. Besides surface activity, polyalkylene oxide polysiloxane surfactants can also provide other benefits, such as antistatic benefits, lubricity and softness to fabrics.

The preparation of polyalkylene oxide polysiloxanes is well known in the art. Polyalkylene oxide polysiloxanes of the present invention can be prepared according to the procedure set forth in U.S. Pat. No. 3,299,112, incorporated herein by reference. Typically, polyalkylene oxide polysiloxanes of the surfactant blend of the present invention are readily prepared by an addition reaction between a hydrosiloxane (i.e., a siloxane containing silicon-bonded hydrogen) and an alkenyl ether (e.g., a vinyl, allyl, or methallyl ether) of an alkoxy or hydroxy end-blocked polyalkylene oxide). The reaction conditions employed in addition reactions of this type are well known in the art and in general involve heating the reactants (e.g., at a temperature of from about 85° C. to 110° C.) in the presence of a platinum catalyst (e.g., chloroplatinic acid) and a solvent (e.g., toluene) and;

(4) Mixtures Thereof.

In terms of principal solvent reduction, with the invention compositions, a reduction of at least 50% can be made without impairing the performance of the composition compared to compositions without the phase stabilizers hereinbefore described. Using a preferred sub-class, a reduction of more than 80% is possible, and in some cases 100% reduction of added solvent is possible.

C. Optional Ingredients (a). Perfume

The present invention can contain any softener compatible perfume. Suitable perfumes are disclosed in U.S. Pat. Nos. 5,500,138 and 5,652,206, Bacon et al., issued Mar. 19, 1996 and Jul. 29, 1997 respectively, said patents being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, those materials disclosed in said patents.

The perfumes useful in the present invention compositions are preferably substantially free of halogenated materials and nitromusks.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

Perfume can be present at a level of from 0% to about 15%, preferably from about 0.1% to about 8%, and more preferably from about 0.2% to about 5%, by weight of the finished composition. Fabric softener compositions of the present invention provide improved fabric perfume deposition.

(b). Additional Fabric Softener Actives and/or Cationic Charge Boosters (i). Additional Fabric Softener Actives The category of additional fabric softener actives includes, but is not limited to conventional monoquaternary amines especially, but not limited to, compositions comprising actives with two or more hydrophobes and preferably, but not limited to, monoquaternary amines with multiple hydrophobes and low transition temperatures as disclosed below. Additional fabric softener actives also includes, but is not limited to, amphiphilic hydrophobes with nonionic and zwitterionic moieties.

Additional fabric softening agents useful herein are described in U.S. Pat. No. 5,643,865 Mermelstein et al., issued Jul. 1, 1997; U.S. Pat. No. 5,622,925 de Buzzaccarini et al., issued Apr. 22, 1997; U.S. Pat. No. 5,545,350 Baker et al., issued Aug. 13, 1996; U.S. Pat. No. 5,474,690 Wahl et al., issued Dec. 12, 1995; U.S. Pat. No. 5,417,868 Turner et al., issued Jan. 27, 1994; U.S. Pat. No. 4,661,269 Trinh et al., issued Apr. 28, 1987; U.S. Pat. No. 4,439,335 Burns, issued Mar. 27, 1984; U.S. Pat. No. 4,401,578 Verbruggen, issued Aug. 30, 1983; U.S. Pat. No. 4,308,151 Cambre, issued Dec. 29, 1981; U.S. Pat. No. 4,237,016 Rudkin et al., issued Oct. 27, 1978; U.S. Pat. No. 4,233,164 Davis, issued Nov. 11, 1980; U.S. Pat. No. 4,045,361 Watt et al., issued Aug. 30, 1977; U.S. Pat. No. 3,974,076 Wiersema et al., issued Aug. 10, 1976; U.S. Pat. No. 3,886,075 Bernadino, issued May 6, 1975; U.S. Pat. No. 3,861,870 Edwards et al., issued Jan. 21, 1975; and European Patent Application publication No. 472,178, by Yamamura et al., all of said documents being incorporated herein by reference. The compounds of U.S. Pat. Nos. 5,759,990 and 5,757,443, incorporated herein by reference, are especially desirable.

The following are examples of preferred softener actives according to the present invention.

- N,N-di(tallowyl-oxy-ethyl)-N,N-dimethyl ammonium chloride;
- N,N-di(canolyl-oxy-ethyl)-N,N-dimethyl ammonium chloride;
- N,N-di(tallowyl-oxy-ethyl)-N-methyl, N-(2-hydroxyethyl) ammonium methyl sulfate;
- N,N-di(canolyl-oxy-ethyl)-N-methyl, N-(2-hydroxyethyl) ammonium methyl sulfate;
- N,N-di(tallowylamidoethyl)-N-methyl, N-(2-hydroxyethyl) ammonium methyl sulfate;
- N,N-di(2-tallowyloxy-2-oxo-ethyl)-N,N-dimethyl ammonium chloride;
- N,N-di(2-canolyloxy-2-oxo-ethyl)-N,N-dimethyl ammonium chloride;
- N,N-di(2-tallowyloxyethylcarbonyloxyethyl)-N,N-dimethyl ammonium chloride;
- N,N-di(2-canolyloxyethylcarbonyloxyethyl)-N,N-dimethyl ammonium chloride;
- N-(2-tallowoyloxy-2-ethyl)-N-(2-tallowyloxy-2-oxo-ethyl)-N,N-dimethyl ammonium chloride;
- N-(2-canolyloxy-2-ethyl)-N-(2-canolyloxy-2-oxo-ethyl)-N,N-dimethyl ammonium chloride;
- N,N,N-tri(tallowyl-oxy-ethyl)-N-methyl ammonium chloride;
- N,N,N-tri(canolyl-oxy-ethyl)-N-methyl ammonium chloride;
- N-(2-tallowyloxy-2-oxoethyl)-N-(tallowyl)-N,N-dimethyl ammonium chloride;
- N-(2-canolyloxy-2-oxoethyl)-N-(canolyl)-N,N-dimethyl ammonium chloride;
- 1,2-ditallowyloxy-3-N,N,N-trimethylammoniopropane chloride; and 1,2-dicanolyloxy-3-N,N,N-trimethylammoniopropane chloride;

and mixtures of the above actives.

Particularly preferred is N,N-di(tallowoyl-oxy-ethyl)-N,N-dimethyl ammonium chloride, where the tallow chains are at least partially unsaturated and N,N-di(canoloyl-oxy-ethyl)-N,N-dimethyl ammonium chloride, N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and/or mixtures thereof.

(ii). Cationic Charge Boosters

Cationic charge boosters can be added to the rinse-added fabric softening compositions of the present invention if needed. Some of the charge boosters serve other functions as described hereinbefore. Typically, ethanol is used to prepare many of the below listed ingredients and is therefore a source of solvent into the final product formulation. The formulator is not limited to ethanol, but instead can add other solvents inter alia hexyleneglycol to aid in formulation of the final composition. As disclosed hereinbefore, the cationic amine bilayer modifier can serve this function. Thus the same material can serve two functions, but should only be counted in the formula once. Some of the charge boosters do not function as bilayer modifiers and therefore are "additional" ingredients.

The preferred cationic charge boosters of the present invention are described herein below.

Polyvinyl Amines

A preferred composition according to the present invention contains at least about 0.2%, preferably from about 0.2% to about 5%, more preferably from about 0.2% to about 2% by weight, of one or more polyvinyl amines having the formula $$—[—CH_2—CH(NH_2)—]_y—$$

wherein y is from about 3 to about 10,000, preferably from about 10 to about 5,000, more preferably from about 20 to about 500. Polyvinyl amines suitable for use in the present invention are available from BASF. The polyvinyl amine can further comprise polyvinyl formamide units resulting from (intended or unintended) incomplete hydrolysis of the parent polyvinylformamide polymer during synthesis. These polyvinylamines have the formula:

$$—[—CH_2—CH(NH_2)—]_y—[—CH_2CH(NHC(O)H)—]_z—$$

where y+z is from about 3, more preferably from about 5, most preferably from about 10 to about10,000, more preferably to about 5000, most preferably to about 500 and the y:z is from 100:0 to 10:90.

Optionally, one or more of the polyvinyl amine backbone $—NH_2$ unit hydrogens can be substituted by an alkyleneoxy unit having the formula:

$$—(R^1O)_xR^2$$

wherein $R^1$ is $C_2$–$C_4$ linear or branched alkyl , $R^2$ is hydrogen, $C_1$–$C_4$ alkyl, and/or mixtures thereof; x is from 1 to 50. In one embodiment or the present invention the polyvinyl amine is reacted first with a substrate which places a 2-propyleneoxy unit directly on the nitrogen followed by reaction of one or more moles of ethylene oxide to form a unit having the general formula:

$$—[CH_2C(CH_3)HO]—(CH_2CH_2O)_xH$$

wherein x has the value of from 1 to about 50. Substitutions such as the above are represented by the abbreviated formula $PO—EO_x—$. However, more than one propyleneoxy unit can be incorporated into the alkyleneoxy substituent.

Polyvinyl amines are especially preferred for use as cationic charge booster in liquid fabric softening compositions since the greater number of amine moieties per unit weight provides substantial charge density. In addition, the cationic charge is generated in situ and the level of cationic charge can be adjusted by the formulator.

Polyalkyleneimines

A preferred composition of the present invention comprises at least about 0.2%, preferably from about 0.2% to about 10%, more preferably from about 0.2% to about 5% by weight, of a polyalkyleneimine charge booster having the formula:

$$(H_2N—R)_{n+1}—[N(H)—R]_m—[N(-)—R]—NH_2$$

wherein the value of m is from 2 to about 700 and the value of n is from 0 to about 350. Preferably the compounds of the present invention comprise polyamines having a ratio of m:n that is at least 1:1 but can include linear polymers (n equal to 0) as well as a range as high as 10:1, preferably the ratio is 2:1. When the ratio of m:n is 2:1, the ratio of primary:secondary:tertiary amine moieties, that is the ratio of $—RNH_2$, —RNH, and —RN moieties, is 1:2:1.

R units are $C_2$–$C_8$ alkylene, $C_3$–$C_8$ alkyl substituted alkylene, and/or mixtures thereof, preferably ethylene, 1,2-propylene, 1,3-propylene, and/or mixtures thereof, more preferably ethylene. R units serve to connect the amine nitrogen atoms of the backbone.

The polyamine backbones have the general formula:

$$[E_2N—R]_w[N(E)—R]_x[N(B)—R]_YNE_2$$

said backbones prior to subsequent modification, comprise primary, secondary and tertiary amine nitrogens connected by R "linking" units. The backbones are comprised of essentially three types of units, which can be randomly distributed along the chain.

The units which make up the polyalkyleneimine backbones are primary amine units having the formula:

$$H_2N—R— \text{ and } —NH_2$$

which terminate the main backbone and any branching chains, secondary amine units having the formula:

$$—[N(H)—R]—$$

which propagate the backbone and tertiary amine units having the formula:

$$—[N(B)—R]—$$

which are the branching points of the main and secondary backbone chains, B representing a continuation of the chain structure by branching. The tertiary units have no replaceable hydrogen atom and are therefore not modified by substitution. During the formation of the polyamine backbones cyclization may occur, therefore, an amount of cyclic polyamine can be present in the parent polyalkyleneimine backbone mixture. Each primary and secondary amine unit of the cyclic alkyleneimines undergoes modification in the same manner as linear and branched polyalkyleneimines.

R is $C_2$–$C_6$ linear alkylene, $C_3$–$C_6$ branched alkylene, and/or mixtures thereof, preferred branched alkylene is 1,2-propylene; preferred R is ethylene. The preferred polyalkyleneimines of the present invention have backbones which comprise the same R unit, for example, all units are ethylene. Most preferred backbone comprises R groups which are all ethylene units.

The polyalkyleneimines of the present invention are preferably modified by substitution of each N—H unit hydrogen with an alkyleneoxy unit having the formula:

$$-(R^1O)_nR^2$$

wherein $R^1$ is ethylene, 1,2-propylene, 1,3-propylene, 1,2-butylene, 1,4-butylene, and/or mixtures thereof, preferably ethylene and 1,2-propylene, more preferably ethylene. $R^2$ is hydrogen, $C_1$–$C_4$ alkyl, and/or mixtures thereof, preferably hydrogen or methyl, more preferably hydrogen. The value of the index n is dependent upon the benefits and properties which the formulator wishes to provide. The value of the index n is from 1 to about 100. Further, any or all of the nitrogens which comprise the polyalkyleneimine backbone can be optionally "modified" by quaternization (for example with methyl groups) or by oxidation to the N-oxide. Mixtures of these substitutions can be employed.

The polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference. In addition to the linear and branched PEI's, the present invention also includes the cyclic amines that are typically formed as artifacts of synthesis. The presence of these materials can be increased or decreased depending on the conditions chose by the formulator.

A further description of polyamine compounds is found in U.S. Pat. No. 4,891,160 Vander Meer, issued Jan. 2, 1990; U.S. Pat. No. 4,597,898, Vander Meer, issued Jul. 1, 1986; European Patent Application 111,965, Oh and Gosselink, published Jun. 27, 1984; European Patent Application 111,984, Gosselink, published Jun. 27, 1984; European Patent Application 112,592, Gosselink, published Jul. 4, 1984; U.S. Pat. No. 4,548,744, Connor, issued Oct. 22, 1985; and U.S. Pat. No. 5,565,145 Watson et al., issued Oct. 15, 1996; all of which are included herein by reference.

The above alkoxylated compounds can also function as dispersants.

The preferred polyamine cationic charge boosters suitable for use in rinse-added fabric softener compositions comprise backbones wherein less than 50% of the R groups comprise more than 3 carbon atoms. The use of two and three carbon spacers as R moieties between nitrogen atoms in the backbone is advantageous for controlling the charge booster properties of the molecules. More preferred embodiments of the present invention comprise less than 25% moieties having more than 3 carbon atoms. Yet more preferred backbones comprise less than 10% moieties having more than 3 carbon atoms.

The cationic charge boosting polyamines of the present invention comprise homogeneous or non-homogeneous polyamine backbones, preferably homogeneous backbones. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone that are present due to an artifact of the chosen method of chemical synthesis. For example, it is known to those skilled in the art that ethanolamine can be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention.

The term "non-homogeneous polymer backbone" refers to polyamine backbones that are a composite of one or more alkylene or substituted alkylene moieties, for example, ethylene and 1,2-propylene units taken together as R units However, not all of the suitable charge booster agents belonging to this category of polyamine comprise the above described polyamines. Other polyamines that comprise the backbone of the compounds of the present invention are generally polyalkyleneamines (PAA's), polyalkyleneimines (PAI's), preferably polyethyleneamine (PEA's), or polyethyleneimines (PEI's). A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

Cationic Polymers

Composition herein can contain from about 0.001% to about 10%, preferably from about 0.01% to about 5%, more preferably from about 0.1% to about 2%, of cationic polymer, typically having a molecular weight of from about 500 to about 1,000,000, preferably from about 1,000 to about 500,000, more preferably from about 1,000 to about 250,000, and even more preferably from about 2,000 to about 100,000 and a charge density of at least about 0.01 meq/gm., preferably from about 0.1 to about 8 meq/gm., more preferably from about 0.5 to about 7, and even more preferably from about 2 to about 6.

The cationic polymers of the present invention can be amine salts or quaternary ammonium salts. Preferred are quaternary ammonium salts. They include cationic derivatives of natural polymers such as some polysaccharide, gums, starch and certain cationic synthetic polymers such as polymers and copolymers of cationic vinyl pyridine or vinyl pyridinium halides. Preferably the polymers are water soluble, for instance to the extent of at least 0.5% by weight at 20° C. Preferably they have molecular weights of from about 600 to about 1,000,000, more preferably from about 600 to about 500,000, even more preferably from about 800 to about 300,000, and especially from about 1000 to 10,000. As a general rule, the lower the molecular weight the higher the degree of substitution (D.S.) by cationic, usually quaternary groups, which is desirable, or, correspondingly, the lower the degree of substitution the higher the molecular weight which is desirable, but no precise relationship appears to exist. In general, the cationic polymers should have a charge density of at least about 0.01 meq/gm., preferably from about 0.1 to about 8 meq/gm., more preferably from about 0.5 to about 7, and even more preferably from about 2 to about 6.

Suitable desirable cationic polymers are disclosed in "CTFA International Cosmetic Ingredient Dictionary, Fourth Edition, J. M. Nikitakis, et al, Editors, published by the Cosmetic, Toiletry, and Fragrance Association, 1991, incorporated herein by reference. The list includes the following nonlimiting examples:

Of the polysaccharide gums, guar and locust bean gums, which are galactomannam gums are available commercially, and are preferred. Thus guar gums are marketed under Trade Names CSAA M/200, CSA 200/50 by Meyhall and Stein-Hall, and hydroxyalkylated guar gums are available from the same suppliers. Other polysaccharide gums commercially available include: Xanthan Gum; Ghatti Gum; Tamarind Gum; Gum Arabic; and Agar.

Cationic guar gums and methods for making them are disclosed in British Pat. No. 1,136,842 and U.S. Pat. No. 4,031,307. Preferably they have a D.S. of from 0.1 to about 0.5.

An effective cationic guar gum is Jaguar C-13S (Trade Name—Meyhall). Cationic guar gums are a highly preferred group of cationic polymers in compositions according to the invention and act both as scavengers for residual anionic surfactant and also add to the softening effect of cationic textile softeners even when used in baths containing little or no residual anionic surfactant. The other polysaccharide-based gums can be quaternized similarly and act substantially in the same way with varying degrees of effectiveness. Suitable starches and derivatives are the natural starches such as those obtained from maize, wheat, barley etc., and from roots such as potato, tapioca etc., and dextrins, particularly the pyrodextrins such as British gum and white dextrin.

Other effective cationic polymers include polyamines formed via the condensation of epichlorohydrin and dialkyl amines depicted by the general formula below:

$$—[N^+(R^1)(R^2)—CH_2—CH(OH)CH_2]_x—$$

With R1 and R1 being the same or different and comprising carbon backbones with 1 to about 22 carbons. The carbon backbones can contain interrupters or substituents comprising heteroatoms such as nitrogen, oxygen, sulfur, and halogens; preferably, $R^1$=$R^2$=a methyl radical; typical molecular weights are greater than about 10,000, and preferably greater than about 20,000, but below about 500,000 and preferably below about 300,000. Some nonlimiting commercial materials include Cypro® 514, Cypro® 515, and Cypro® 516 from Cytec Industries, Inc, West Patterson, N.J.

Some nonlimiting examples of very effective individual cationic polymers are the following: Polyvinyl pyridine, molecular weight about 40,000, with about 60% of the available pyridine nitrogen atoms are quaternized.; Copolymer of 70/30 molar proportions of vinyl pyridine/styrene, molecular weight about 43,000, with about 45% of the available pyridine nitrogen atoms quaternized as above; Copolymers of 60/40 molar proportions of vinyl pyridine/acrylamide, with about 35% of the available pyridine nitrogens quaternized as above. Copolymers of 77/23 and 57/43 molar proportions of vinyl pyridine/methyl methacrylate, molecular weight about 43,000, with about 97% of the available pyridine nitrogen atoms quaternized as above.

These cationic polymers are effective in the compositions at very low concentrations for instance from 0.001% by weight to 0.2% especially from about 0.02% to 0.1%. In some instances the effectiveness seems to fall off, when the content exceeds some optimum level, such as for polyvinyl pyridine and its styrene copolymer about 0.05%.

Some other nonlimiting examples of effective cationic polymers are: Copolymer of vinyl pyridine and N-vinyl pyrrolidone (63/37) with about 40% of the available pyridine nitrogens quaternized.; Copolymer of vinyl pyridine and acrylonitrile (60/40), quaternized as above.; Copolymer of N,N-dimethyl amino ethyl methacrylate and styrene (55/45) quaternized as above at about 75% of the available amino nitrogen atoms. Eudragit E (Trade Name of Rohm GmbH) quaternized as above at about 75% of the available amino nitrogen atoms. Eudragit E is believed to be copolymer of N,N-dialkyl amino alkyl methacrylate and a neutral acrylic acid ester, and to have molecular weight about 100,000 to 1,000,000.; Copolymer of N-vinyl pyrrolidone and N,N-diethyl amino methyl methacrylate (40/50), quaternized at about 50% of the available amino nitrogen atoms.; These cationic polymers can be prepared in a known manner by quaternizing the basic polymers.

Yet other nonlimiting examples of cationic polymeric salts are quaternized polyethyleneimines. These have at least 10 repeating units, some or all being quaternized. Commercial examples of polymers of this class are also sold under the generic Trade Name Alcostat by Allied Colloids.

Another nonlimiting example of effective cationic polymers include the polydiallydimethyl ammonium chlorides. Typically these have molecular weights greater than about 10,000 K and less than about 1,000,000. Some nonlimiting commercial examples of these materials include Magnifloc® 587, Magnifloc® 589, Magnifloc® 591, and Magnifloc® 592 from Cytec Industries, Inc.

Typical examples of polymers are disclosed in U.S. Pat. No. 4,179,382, incorporated herein by reference.

Each polyamine nitrogen whether primary, secondary or tertiary, is further defined as being a member of one of three general classes; simple substituted, quaternized or oxidized.

The polymers are made neutral by water soluble anions such as chlorine ($Cl^-$), bromine ($Br^-$), iodine ($I^-$) or any other negatively charged radical such as sulfate ($SO_4^{2-}$) and methosulfate ($CH_3SO_3^-$).

Specific polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

An example of modified polyamine cationic polymers of the present invention comprising PEI's comprising a PEI backbone wherein all substitutable nitrogens are modified by replacement of hydrogen with a polyoxyalkyleneoxy unit, $—(CH_2CH_2O)_7H$. Other suitable polyamine cationic polymers comprise this molecule which is then modified by subsequent oxidation of all oxidizable primary and secondary nitrogen atoms to N-oxides and/or some backbone amine units are quaternized, e.g. with methyl groups.

Of course, mixtures of any of the above described cationic polymers can be employed, and the selection of individual polymers or of particular mixtures can be used to control the physical properties of the compositions such as viscosity and stability.

(c). Other Optional Ingredients (i). Brighteners

The compositions herein can also optionally contain from about 0.005% to about 5% by weight of certain types of hydrophilic optical brighteners which also provide a dye transfer inhibition action. If used, the compositions herein will preferably comprise from about 0.001% to about 1% by weight of such optical brighteners.

The hydrophilic optical brighteners useful in the present invention are those described in said U.S. Pat. No. 5,759,990 at column 21, lines 15–60.

(ii). Chemical Stabilizers

Chemical stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and, preferably, from about 0.01% to about 0.2% for reductive agents. These assure good odor stability under long term storage conditions. Antioxidants and reductive agent stabilizers are especially critical for unscented or low scent products (no or low perfume).

Examples of antioxidants that can be added to the compositions and in the processing of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and/or mixtures thereof; preferably Irganox® 3125, Irganox® 1425, Irganox® 3114, and/or mixtures thereof; more preferably Irganox® 3125 alone or mixed with citric acid and/or other chelators such as isopropyl citrate, Dequest® 2010, available from Monsanto with a chemical name of 1-hydroxyethylidene-1,1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid.

(iii). Soil Release Agent

Suitable soil release agents are disclosed in the U.S. Pat. No. 5,759,990 at column 23, line 53 through column 25, line 41. The addition of the soil release agent can occur in combination with the premix, in combination with the acid/water seat, before or after electrolyte addition, or after the final composition is made. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780® (from Dupont) and Milease T® (from ICI).

These soil release agents can also act as a scum dispersant.

(iv). Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl4-isothiazoline-3-one and 2-methyl4-isothiazoline-3-one sold by Rohm and Haas Company under the trade name Kathon® about 1 to about 1,000 ppm by weight of the agent.

(v). Chelating Agents

The compositions and processes herein can optionally employ one or more copper and/or nickel chelating agents ("chelators"). Such water-soluble chelating agents can be selected from the group consisting of amino carboxylates, amino phosphonates, polyfunctionally-substituted aromatic chelating agents and/or mixtures thereof, all as hereinafter defined. The whiteness and/or brightness of fabrics are substantially improved or restored by such chelating agents and, as discussed before, the stability of the materials in the compositions are improved.

The chelating agents disclosed in said U.S. Pat. No. 5,759,990 at column 26, line 29 through column 27, line 38 are suitable.

The chelating agents are typically used in the present rinse process at levels from about 2 ppm to about 25 ppm, for periods from 1 minute up to several hours' soaking.

A preferred EDDS chelator that can be used herein (also known as ethylenediamine-N,N'-disuccinate) is the material described in U.S. Pat. No. 4,704,233, cited hereinabove, and has the formula (shown in free acid form):

$$HN(L)C_2H_4N(L)H$$

wherein L is a $CH_2(COOH)CH_2(COOH)$ group.

A wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels can be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein, in addition to those that are stabilizers. Preferred chelators include DETMP, diethylenediaminepentaacetic acid (DETPA), nitrilotriacetate (NTA), ethylenediamine disuccinate (EDDS), TPED, and/or mixtures thereof. Such materials can also provide crystal growth inhibition.

(vi). Color Care Agent

The composition can optionally comprise from about 0.1% to about 50% of by weight of the composition of a color care agent having the formula:

$$(R_1)(R_2)N(CX_2)_nN(R_3)(R_4)$$

wherein X is selected from the group consisting of hydrogen, linear or branched, substituted or unsubstituted alkyl having from 1 to 10 carbons atoms and substituted or unsubstituted aryl having at least 6 carbon atoms; n is an integer from 0 to 6; $R_1$, $R_2$, $R_3$, and $R_4$ are independently selected from the group consisting of alkyl; aryl; alkaryl; arylalkyl; hydroxyalkyl; polyhydroxyalkyl; polyalkylether having the formula —$((CH_2)_yO)_zR_7$ where $R_7$ is hydrogen or a linear, branched, substituted or unsubstituted alkyl chain having from 1 to 10 carbon atoms and where y is an integer from 2 to 10 and z is an integer from 1 to 30; alkoxy; polyalkoxy having the formula: —$(O(CH_2)_y)_zR_7$; the group —$C(O)R_8$ where $R_8$ is alkyl; alkaryl; arylalkyl; hydroxyalkyl; polyhydroxyalkyl and polyalkylether as defined in $R_1$, $R_2$, $R_3$, and $R_4$; $(CX_2)_nN(R_5)(R_6)$ with no more than one of $R_1$, $R_2$, $R_3$, and $R_4$ being $(CX_2)_nN(R_5)(R_6)$ and wherein $R_5$ and $R_6$ are alkyl; alkaryl; arylalkyl; hydroxyalkyl; polyhydroxyalkyl; polyalkylether; alkoxy and polyalkoxy as defined in $R_1$, $R_2$, $R_3$, and $R_4$; and either of $R_1$+$R_3$ or $R_4$ or $R_2$+$R_3$ or $R_4$ can combine to form a cyclic substituent.

Preferred agents include those where $R_1$, $R_2$, $R_3$, and $R_4$ are independently selected from the group consisting of alkyl groups having from 1 to 10 carbon atoms and hydroxyalkyl groups having from 1 to 5 carbon atoms, preferably ethyl, methyl, hydroxyethyl, hydroxypropyl and isohydroxypropyl. Also preferred are agents wherein one of R1, R2, R3, R4 is $(CX2)_nN(R5)(R6)$, n=3, 4, 6, or mixtures thereof, and remaining R's are independently selected from H, linear or branched C1–10 alkyl, preferably H or methyl. The color care agent has more than about 1% nitrogen by weight of the compound, and preferably more than 7%. A preferred agent is tetrakis -(2-hydroxylpropyl) ethylenediamine (TPED). These compounds can also function as chelants.

(vii). Silicones

The silicone herein can be either a polydimethyl siloxane (polydimethyl silicone or PDMS), or a derivative thereof, e.g., amino silicones, ethoxylated silicones, etc. The PDMS, is preferably one with a low molecular weight, e.g., one having a viscosity of from about 2 to about 5000 cSt, preferably from about 5 to about 500 cSt, more preferably from about 25 to about 200 cSt Silicone emulsions can conveniently be used to prepare the compositions of the present invention. However, preferably, the silicone is one that is, at least initially, not emulsified. I.e., the silicone should be emulsified in the composition itself. In the process of preparing the compositions, the silicone is preferably added to the "water seat", which comprises the water and, optionally, any other ingredients that normally stay in the aqueous phase.

Low molecular weight PDMS is preferred for use in the fabric softener compositions of this invention. The low molecular weight PDMS is easier to formulate without pre-emulsification.

Silicone derivatives such as amino-functional silicones, quaternized silicones, and silicone derivatives containing Si—OH, Si—H, and/or Si—Cl bonds, can be used. However, these silicone derivatives are normally more substantive to fabrics and can build up on fabrics after repeated treatments to actually cause a reduction in fabric absorbency.

When added to water, the fabric softener composition deposits the biodegradable cationic fabric softening active on the fabric surface to provide fabric softening effects. However, in a typical laundry process, using an automatic washer, cotton fabric water absorbency can be appreciably reduced at high softener levels and/or after multiple cycles. The silicone improves the fabric water absorbency, especially for freshly treated fabrics, when used with this level of fabric softener without adversely affecting the fabric softening performance. The mechanism by which this improvement in water absorbency occurs is not understood, since the silicones are inherently hydrophobic. It is very surprising that there is any improvement in water absorbency, rather than additional loss of water absorbency.

The amount of PDMS needed to provide a noticeable improvement in water absorbency is dependent on the initial rewettability performance, which, in turn, is dependent on the detergent type used in the wash. Effective amounts range from about 2 ppm to about 50 ppm in the rinse water, preferably from about 5 to about 20 ppm. The PDMS to softener active ratio is from about 2:100 to about 50:100, preferably from about 3:100 to about 35:100, more preferably from about 4:100 to about 25:100. As stated hereinbefore, this typically requires from about 0.2% to about 20%, preferably from about 0.5% to about 10%, more preferably from about 1% to about 5% silicone.

The PDMS also improves the ease of ironing in addition to improving the rewettability characteristics of the fabrics. When the fabric care composition contains an optional soil release polymer, the amount of PDMS deposited on cotton fabrics increases and PDMS improves soil release benefits on polyester fabrics. Also, the PDMS improves the rinsing characteristics of the fabric care compositions by reducing the tendency of the compositions to foam during the rinse. Surprisingly, there is little, if any, reduction in the softening characteristics of the fabric care compositions as a result of the presence of the relatively large amounts of PDMS.

The present invention can include other optional components conventionally used in textile treatment compositions, for example: colorants; preservatives; surfactants; anti-shrinkage agents; fabric crisping agents; spotting agents; germicides; fungicides; anti-corrosion agents; enzymes such as proteases, cellulases, amylases, lipases, etc.; and the like.

The present invention can also include other compatible ingredients, including those disclosed U.S. Pat. No. 5,686,376, Rusche, et al.; issued Nov. 11, 1997, Shaw, et al.; and U.S. Pat. No. 5,536,421, Hartman, et al., issued Jul. 16, 1996, said patents being incorporated herein by reference.

All parts, percentages, proportions, and ratios herein are by weight unless otherwise specified and all numerical values are approximations based upon normal confidence limits. All documents cited are, in relevant part, incorporated herein by reference.

(viii). Fabric Abrasion Reducing Polymers

The compositions of the present invention comprise from about 0.01%, preferably from about 0.1% to about 20%, preferably to about 10% by weight, of a fabric abrasion reducing polymer.

The fabric abrasion reducing polymers useful in the present invention have the formula:

$$[—P(D)_m—]_n$$

wherein the unit P is a polymer backbone which comprises units which are homopolymeric or copolymeric. D units are defined herein below. For the purposes of the present invention the term "homopolymeric" is defined as "a polymer backbone which is comprised of units having the same unit composition, i.e., formed from polymerization of the same monomer". For the purposes of the present invention the term "copolymeric" is defined as "a polymer backbone which is comprised of units having a different unit composition, i.e., formed from the polymerization of two or more monomers".

P backbones preferably comprise units having the formula:

$$—[CR_2—CR_2]— \text{ or } —[(CR_2)_x—L]—$$

wherein each R unit is independently hydrogen, $C_1$–$C_{12}$ alkyl, $C_6$–$C_{12}$ aryl, and D units as described herein below; preferably $C_1$–$C_4$ alkyl.

Each L unit is independently selected from heteroatom-containing moieties, non-limiting examples of which are selected from the group consisting of:

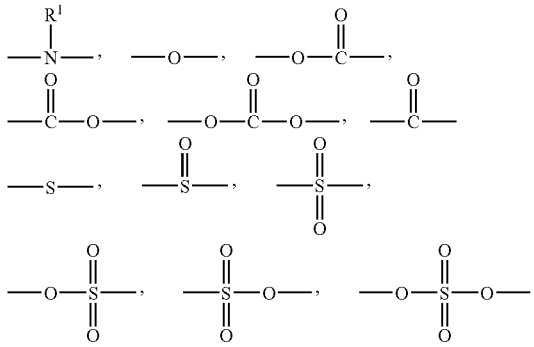

polysiloxane having the formula:

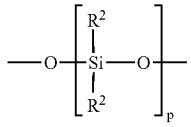

wherein the index p is from 1 to about 6; units which have dye transfer inhibition activity:

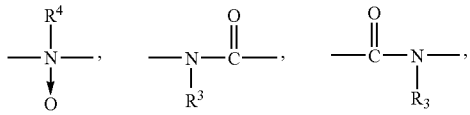

and mixtures thereof; wherein $R^1$ is hydrogen, $C_1$–$C_{12}$ alkyl, $C_6$–$C_{12}$ aryl, and mixtures thereof. $R^2$ is $C_1$–$C_{12}$ alkyl, $C_1$–$C_{12}$ alkoxy, $C_6$–$_{12}$ aryloxy, and mixtures thereof; preferably methyl and methoxy. $R^3$ is hydrogen $C_1$–$C_{12}$ alkyl, $C_6$–$C_{12}$ aryl, and mixtures thereof; preferably hydrogen or $C_1$–$C_4$ alkyl, more preferably hydrogen. $R^4$ is $C_1$–$C_{12}$ alkyl, $C_6$–$C_{12}$ aryl, and mixtures thereof.

The backbones of the fabric abrasion reducing polymers of the present invention comprise one or more D units which are units which comprise one or more units which provide a dye transfer inhibiting benefit. The D unit can be part of the backbone itself as represented in the general formula:

$$[—P(D)_m—]_n$$

or the D unit may be incorporated into the backbone as a pendant group to a backbone unit having, for example, the formula:

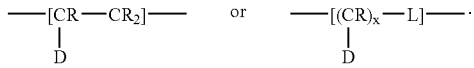

However, the number of D units depends upon the formulation. For example, the number of D units will be adjusted to formula stability as well as efficacy of any optional dye transfer inhibition while providing a polymer which has fabric abrasion reducing properties. The molecular weight of the fabric abrasion reducing polymers of the present invention are from about 500, preferably from about 1,000; to about 6,000,000, preferably to about 2,000,000 daltons. Therefore the value of the index n is selected to provide the indicated molecular weight.

Polymers Comprising Amide Units

Non-limiting examples of preferred D units are D units which comprise an amide moiety. Examples of polymers wherein an amide unit is introduced into the polymer via a pendant group includes polyvinylpyrrolidone having the formula:

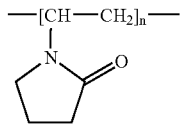

polyvinyloxazolidone having the formula:

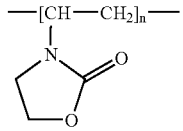

polyvinylmethyloxazolidone having the formula:

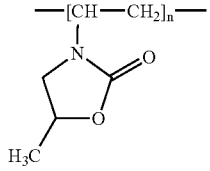

polyacrylamides and N-substituted polyacrylamides having the formula:

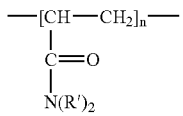

wherein each R' is independently hydrogen, $C_1$–$C_6$ alkyl, or both R' units can be taken together to form a ring comprising 4–6 carbon atoms; polymethacrylamides and N-substituted polymethacrylamides having the general formula:

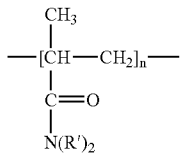

wherein each R' is independently hydrogen, $C_1$–$C_6$ alkyl, or both R' units can be taken together to form a ring comprising 4–6 carbon atoms; poly(N-acrylylglycinamide) having the formula:

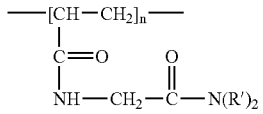

wherein each R' is independently hydrogen, $C_1$–$C_6$ alkyl, or both R' units can be taken together to form a ring comprising 4–6 carbon atoms; poly(N-methacrylylglycinamide) having the formula:

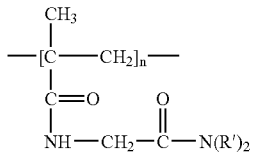

wherein each R' is independently hydrogen, $C_1$–$C_6$ alkyl, or both R' units can be taken together to form a ring comprising 4–6 carbon atoms; polyvinylurethanes having the formula:

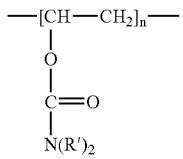

wherein each R' is independently hydrogen, $C_1$–$C_6$ alkyl, or both R' units can be taken together to form a ring comprising 4–6 carbon atoms.

An example of a D unit wherein the nitrogen of the dye transfer inhibiting moiety is incorporated into the polymer backbone is a poly(2-ethyl-2-oxazoline) having the formula:

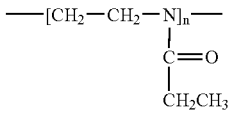

wherein the index n indicates the number of monomer residues present.

The fabric abrasion reducing polymers of the present invention can comprise any mixture of dye transfer inhibition units which provides the product with suitable properties.

The preferred polymers which comprise D units which are amide moieties are those which have the nitrogen atoms of the amide unit highly substituted so the nitrogen atoms are in effect shielded to a varying degree by the surrounding non-polar groups. This provides the polymers with an amphiphilic character. Non-limiting examples include polyvinyl-pyrrolidones, polyvinyloxazolidones, N,N-disubstituted polyacrylamides, and N,N-disubstituted polymethacrylamides. A detailed description of physicochemical properties of some of these polymers are given in "Water-Soluble Synthetic Polymers: Properties and Behavior", Philip Molyneux, Vol. I, CRC Press, (1983) included herein by reference.

The amide containing polymers may be present partially hydrolyzed and/or crosslinked forms. A preferred polymeric compound for the present invention is polyvinylpyrrolidone (PVP). This polymer has an amphiphilic character with a highly polar amide group conferring hydrophilic and polar-attracting properties, and also has non-polar methylene and methine groups, in the backbone and/or the ring, conferring hydrophobic properties. The rings may also provide planar alignment with the aromatic rings in the dye molecules. PVP is readily soluble in aqueous and organic solvent systems. PVP is available ex ISP, Wayne, N.J., and BASF Corp., Parsippany, N.J., as a powder or aqueous solutions in several viscosity grades, designated as, e.g., K-12, K-15, K-25, and K-30. These K-values indicate the viscosity average molecular weight, as shown below:

| | K-12 | K-15 | K-25 | K-30 | K-60 | K-90 |
|---|---|---|---|---|---|---|
| PVP viscosity average molecular weight (in thousands of daltons) | 2.5 | 10 | 24 | 40 | 160 | 360 |

PVP K-12, K-15, and K-30 are also available ex Polysciences, Inc. Warrington, Pa., PVP K-15, K-25, and K-30 and poly(2-ethyl-2-oxazoline) are available ex Aldrich Chemical Co., Inc., Milwaukee, Wis. PVP K30 (40,000) through to K90 (360,000) are also commercially available ex BASF under the tradename Luviskol or commercially available ex ISP. Still higher molecular PVP like PVP 1.3MM, commercially available ex Aldrich is also suitable for use herein. Yet further PVP-type of material suitable for use in the present invention are polyvinylpyrrolidone-co-dimethylaminoethylmethacrylate, commercially available commercially ex ISP in a quaternised form under the tradename Gafquat® or commercially available ex Aldrich Chemical Co. having a molecular weight of approximately 1.0 MM; polyvinylpyrrolidone-co-vinyl acetate, available ex BASF under the tradename Luviskol®, available in vinylpyrrolidone:vinylacetate ratios of from 3:7 to 7:3.

Polymers Comprising N-Oxide Units

Another D unit which provides dye transfer inhibition enhancement to the fabric abrasion reducing polymers described herein, are N-oxide units having the formula:

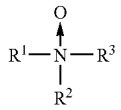

wherein $R^1$, $R^2$, and $R^3$ can be any hydrocarbyl unit (for the purposes of the present invention the term "hydrocarbyl" does not include hydrogen atom alone). The N-oxide unit may be part of a polymer, such as a polyamine, i.e., polyalkyleneamine backbone, or the N-oxide may be part of a pendant group attached to the polymer backbone. An example of a polymer which comprises an the N-oxide unit as a part of the polymer backbone is polyethyleneimine N-oxide. Non-limiting examples of groups which can comprise an N-oxide moiety include the N-oxides of certain heterocycles inter alia pyridine, pyrrole, imidazole, pyrazole, pyrazine, pyrimidine, pyridazine, piperidine, pyrrolidine, pyrrolidone, azolidine, morpholine. A preferred polymer is poly(4-vinylpyriding N-oxide, PVNO). In addition, the N-oxide unit may be pendant to the ring, for example, aniline oxide.

N-oxide comprising polymers of the present invention will preferably have a ration of N-oxidized amine nitrogen to non-oxidized amine nitrogen of from about 1:0 to about 1:2, preferably to about 1:1, more preferably to about 3:1. The amount of N-oxide units can be adjusted by the formulator. For example, the formulator may co-polymerize N-oxide comprising monomers with non N-oxide comprising monomers to arrive at the desired ratio of N-oxide to non N-oxide amino units, or the formulator may control the oxidation level of the polymer during preparation. The amine oxide unit of the polyamine N-oxides of the present invention have a $Pk_a$ less than or equal to 10, preferably less than or equal to 7, more preferably less than or equal to 6. The average molecular weight of the N-oxide comprising polymers which provide a dye transfer inhibitor benefit to reduced fabric abrasion polymers is from about 500 daltons, preferably from about 100,000 daltons, more preferably from about 160,000 daltons to about 6,000,000 daltons, preferably to about 2,000,000 daltons, more preferably to about 360,000 daltons.

Polymers Comprising Amide Units and N-oxide Units

A further example of polymers which are fabric abrasion reducing polymers which have dye transfer inhibition benefits are polymers which comprise both amide units and N-oxide units as described herein above. Non-limiting examples include co-polymers of two monomers wherein the first monomer comprises an amide unit and the second monomer comprises an N-oxide unit. In addition, oligomers or block polymers comprising these units can be taken together to form the mixed amide/N-oxide polymers. However, the resulting polymers must retain the water solubility requirements described herein above.

Molecular Weight

For all the above described polymers of the invention, it is most preferred that they have a molecular weight in the range as described herein above. This range is typically higher than the range for polymers which render only dye transfer inhibition benefits alone. Indeed, the higher molecular weight of the abrasion reducing polymers provides for reduction of fabric abrasion which typically occurs subsequent to treatment, for example during garment use, or in a washing procedure. Not to be bound by theory, it is believed that the high molecular weight enables the deposition of the polymer on the fabric surface and provides sufficient substantivity so that the polymer is capable of remaining on the fabric during subsequent use and subsequent laundering of the fabric. Further, it is believed that for a given charge density, increasing the molecular weight will increase the substantivity of the polymer to the fabric surface. Ideally the balance of charge density and molecular weight will provide both a sufficient attraction to the fabric during subsequent wash cycles. Increasing molecular weight is considered preferable to increasing charge density as it allows a greater choice in the range of materials which can provide the desired benefit and avoids the negative impact that increasing charge density may have on the attraction of soil and residue onto treated fabrics. It should be noted, however, that a similar benefit may be predicted from the approach of increasing charge density while retaining a lower molecular weight material.

(ix). Malodor Control Agents

Cyclodextrin

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structures with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules to absorb (form inclusion complexes with) organic molecules or parts of organic molecules which can fit into the cavity. Many odorous molecules can fit into the cavity including many malodorous molecules and perfume molecules. Therefore, cyclodextrins, and especially mixtures of cyclodextrins with different size cavities, can be used to control odors caused by a broad spectrum of organic odoriferous materials, which may, or may not, contain reactive functional groups. The complexation between cyclodextrin and odorous molecules occurs rapidly in the presence of water. However, the extent of the complex formation also depends on the polarity of the absorbed molecules. In an aqueous solution, strongly hydrophilic molecules (those which are highly water-soluble) are only partially absorbed, if at all. Therefore, cyclodextrin does not complex effectively with some very low molecular weight organic amines and acids when they are present at low levels on wet fabrics. As the water is being removed however, e.g., the fabric is being dried off, some low molecular weight organic amines and acids have more affinity and will complex with the cyclodextrins more readily.

The cavities within the cyclodextrin in the solution of the present invention should remain essentially unfilled (the cyclodextrin remains uncomplexed) while in solution, in order to allow the cyclodextrin to absorb various odor molecules when the solution is applied to a surface. Non-derivatised (normal) beta-cyclodextrin can be present at a level up to its solubility limit of about 1.85% (about 1.85 g in 100 grams of water) at room temperature. Beta-cyclodextrin is not preferred in compositions which call for a level of cyclodextrin higher than its water solubility limit. Non-derivatised beta-cyclodextrin is generally not preferred when the composition contains surfactant since it affects the surface activity of most of the preferred surfactants that are compatible with the derivatised cyclodextrins.

Preferably, the odor absorbing solution of the present invention is clear. The term "clear" as defined herein means transparent or translucent, preferably transparent, as in "water clear," when observed through a layer having a thickness of less than about 10 cm.

Preferably, the cyclodextrins used in the present invention are highly water-soluble such as, alpha-cyclodextrin and/or derivatives thereof, gamma-cyclodextrin and/or derivatives thereof, derivatised beta-cyclodextrins, and/or mixtures thereof. The derivatives of cyclodextrin consist mainly of molecules wherein some of the OH groups are converted to OR groups. Cyclodextrin derivatives include, e.g., those with short chain alkyl groups such as methylated cyclodextrins, and ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $^-CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio)propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49, said references being incorporated herein by reference; and mixtures thereof. Other cyclodextrin derivatives are disclosed in U.S. Pat. No.: 3,426,011, Parmerter et al., issued Feb. 4, 1969; U.S. Pat. Nos. 3,453,257; 3,453,258; 3,453,259; and 3,453,260, all in the names of Parmerter et al., and all issued Jul. 1, 1969; U.S. Pat. No. 3,459,731, Gramera et al., issued Aug. 5, 1969; U.S. Pat. No. 3,553,191, Parmerter et al., issued Jan. 5, 1971; U.S. Pat. No. 3,565,887, Parmerter et al., issued Feb. 23, 1971; U.S. Pat. No. 4,535,152, Szejtli et al., issued Aug. 13, 1985; U.S. Pat. No. 4,616,008, Hirai et al., issued Oct. 7, 1986; U.S. Pat. No. 4,678,598, Ogino et al., issued Jul. 7, 1987; U.S. Pat. No. 4,638,058, Brandt et al., issued Jan. 20, 1987; and U.S. Pat. No. 4,746,734, Tsuchiyama et al., issued May 24, 1988; all of said patents being incorporated herein by reference.

Highly water-soluble cyclodextrins are those having water solubility of at least about 10 g in 100 ml of water at room temperature, preferably at least about 20 g in 100 ml of water, more preferably at least about 25 g in 100 ml of water at room temperature. The availability of solubilized, uncomplexed cyclodextrins is essential for effective and efficient odor control performance. Solubilized, water-soluble cyclodextrin can exhibit more efficient odor control performance than non-water-soluble cyclodextrin when deposited onto surfaces, especially fabric.

Examples of preferred water-soluble cyclodextrin derivatives suitable for use herein are hydroxypropyl alpha-cyclodextrin, methylated alpha-cyclodextrin, methylated beta-cyclodextrin, hydroxyethyl beta-cyclodextrin, and hydroxypropyl beta-cyclodextrin. Hydroxyalkyl cyclodextrin derivatives preferably have a degree of substitution of from about 1 to about 14, more preferably from about 1.5 to about 7, wherein the total number of OR groups per cyclodextrin is defined as the degree of substitution. Methylated cyclodextrin derivatives typically have a degree of substitution of from about 1 to about 18, preferably from about 3 to about 16. A known methylated beta-cyclodextrin is heptakis-2,6-di-O-methyl-β-cyclodextrin, commonly known as DIMEB, in which each glucose unit has about 2 methyl groups with a degree of substitution of about 14. A preferred, more commercially available, methylated beta-cyclodextrin is a randomly methylated beta-cyclodextrin, commonly known as RAMEB, having different degrees of substitution, normally of about 12.6. RAMEB is more preferred than DIMEB, since DIMEB affects the surface activity of the preferred surfactants more than RAMEB. The preferred cyclodextrins are available, e.g., from Cerestar USA, Inc. and Wacker Chemicals (USA), Inc.

It is also preferable to use a mixture of cyclodextrins. Such mixtures absorb odors more broadly by complexing with a wider range of odoriferous molecules having a wider range of molecular sizes. Preferably at least a portion of the cyclodextrins is alpha-cyclodextrin and its derivatives thereof, gamma-cyclodextrin and its derivatives thereof, and/or derivatised beta-cyclodextrin, more preferably a mixture of alpha-cyclodextrin, or an alpha-cyclodextrin derivative, and derivatised beta-cyclodextrin, even more preferably a mixture of derivatised alpha-cyclodextrin and derivatised beta-cyclodextrin, most preferably a mixture of hydroxypropyl alpha-cyclodextrin and hydroxypropyl beta-cyclodextrin, and/or a mixture of methylated alpha-cyclodextrin and methylated beta-cyclodextrin.

It is preferable that the usage compositions of the present invention contain low levels of cyclodextrin so that a visible stain does not appear on the fabric at normal usage levels. Preferably, the solution used to treat the surface under usage conditions is virtually not discernible when dry. Typical levels of cyclodextrin in usage compositions for usage conditions are from about 0.01% to about 5%, preferably from about 0.1% to about 4%, more preferably from about 0.5% to about 2% by weight of the composition. Compositions with higher concentrations can leave unacceptable visible stains on fabrics as the solution evaporates off of the fabric. This is especially a problem on thin, colored, synthetic fabrics. In order to avoid or minimize the occurrence of fabric staining, it is preferable that the fabric be treated at a level of less than about 5 mg of cyclodextrin per gram of fabric, more preferably less than about 2 mg of cyclodextrin per gram of fabric. The presence of the surfactant can improve appearance by minimizing localized spotting.

Concentrated compositions can also be used in order to deliver a less expensive product. When a concentrated product is used, i.e., when the level of cyclodextrin used is from about 3% to about 20%, more preferably from about 5% to about 10%, by weight of the concentrated composition, it is preferable to dilute the concentrated composition before treating fabrics in order to avoid staining. Preferably the concentrated cyclodextrin composition is diluted with about 50% to about 6000%, more preferably with about 75% to about 2000%, most preferably with about 100% to about 1000% by weight of the concentrated composition of water. The resulting diluted compositions have usage concentrations of cyclodextrin as discussed hereinbefore, e.g., of from about 0.1% to about 5%, by weight of the diluted composition.

Low Molecular Weight Polyols

Low molecular weight polyols with relatively high boiling points, as compared to water, such as ethylene glycol, propylene glycol and/or glycerol are preferred optional ingredients for improving odor control performance of the composition of the present invention when cyclodextrin is present. Not to be bound by theory, it is believed that the incorporation of a small amount of low molecular weight glycols into the composition of the present invention enhances the formation of the cyclodextrin inclusion complexes as the fabric dries.

It is believed that the polyols' ability to remain on the fabric for a longer period of time than water, as the fabric dries allows it to form ternary complexes with the cyclodextrin and some malodorous molecules. The addition of the glycols is believed to fill up void space in the cyclodextrin cavity that is unable to be filled by some malodor molecules of relatively smaller sizes. Preferably the glycol used is glycerin, ethylene glycol, propylene glycol, diethylene glycol, dipropylene glycol or mixtures thereof, more preferably ethylene glycol and/or propylene glycol. Cyclodextrins prepared by processes that result in a level of such polyols are highly desirable, since they can be used without removal of the polyols.

Some polyols, e.g., dipropylene glycol, are also useful to facilitate the solubilization of some perfume ingredients in the composition of the present invention.

Typically, glycol is added to the composition of the present invention at a level of from about 0.01% to about 3%, by weight of the composition, preferably from about 0.05% to about 1%, more preferably from about 0.1% to about 0.5%, by weight of the composition. The preferred weight ratio of low molecular weight polyol to cyclodextrin is from about 2:1,000 to about 20:100, more preferably from about 3:1,000 to about 15:100, even more preferably from about 5:1,000 to about 10:100, and most preferably from about 1:100 to about 7:100.

Metal Salts

Optionally, but highly preferred, the present invention can include metallic salts for added odor absorption and/or antimicrobial benefit for the cyclodextrin solution when cyclodextrin is present. The metallic salts are selected from the group consisting of copper salts, zinc salts, and mixtures thereof.

Copper salts have some antimicrobial benefits. Specifically, cupric abietate acts as a fungicide, copper acetate acts as a mildew inhibitor, cupric chloride acts as a fungicide, copper lactate acts as a fungicide, and copper sulfate acts as a germicide. Copper salts also possess some malodor control abilities. See U.S. Pat. No. 3,172,817, Leupold, et al., which discloses deodorizing compositions for treating disposable articles, comprising at least slightly water-soluble salts of acylacetone, including copper salts and zinc salts, all of said patents are incorporated herein by reference.

The preferred zinc salts possess malodor control abilities. Zinc has been used most often for its ability to ameliorate malodor, e.g., in mouth wash products, as disclosed in U.S. Pat. No. 4,325,939, issued Apr. 20, 1982 and U.S. Pat. No. 4,469,674, issued Sep. 4, 1983, to N. B. Shah, et al., all of which are incorporated herein by reference. Highly-ionized and soluble zinc salts such as zinc chloride, provide the best source of zinc ions. Zinc borate functions as a fungistat and a mildew inhibitor, zinc caprylate functions as a fungicide, zinc chloride provides antiseptic and deodorant benefits, zinc ricinoleate functions as a fungicide, zinc sulfate heptahydrate functions as a fungicide and zinc undecylenate functions as a fungistat.

Preferably the metallic salts are water-soluble zinc salts, copper salts or mixtures thereof, and more preferably zinc salts, especially $ZnCl_2$. These salts are preferably present in the present invention primarily to absorb amine and sulfur-containing compounds that have molecular sizes too small to be effectively complexed with the cyclodextrin molecules. Low molecular weight sulfur-containing materials, e.g., sulfide and mercaptans, are components of many types of malodors, e.g., food odors (garlic, onion), body/perspiration odor, breath odor, etc. Low molecular weight amines are also components of many malodors, e.g., food odors, body odors, urine, etc.

When metallic salts are added to the composition of the present invention they are typically present at a level of from about 0.1% to about 10%, preferably from about 0.2% to about 8%, more preferably from about 0.3% to about 5% by weight of the usage composition. When zinc salts are used as the metallic salt, and a clear solution is desired, it is preferable that the pH of the solution is adjusted to less than about 7, more preferably less than about 6, most preferably, less than about 5, in order to keep the solution clear.

Soluble Carbonate and/or Bicarbonate Salts

Water-soluble alkali metal carbonate and/or bicarbonate salts, such as sodium bicarbonate, potassium bicarbonate, potassium carbonate, cesium carbonate, sodium carbonate, and mixtures thereof can be added to the composition of the present invention in order to help to control certain acid-type odors. Preferred salts are sodium carbonate monohydrate, potassium carbonate, sodium bicarbonate, potassium bicarbonate, and mixtures thereof. When these salts are added to the composition of the present invention, they are typically present at a level of from about 0.1% to about 5%, preferably from about 0.2% to about 3%, more preferably from about 0.3% to about 2%, by weight of the composition. When these salts are added to the composition of the present invention it is preferably that incompatible metal salts not be present in the invention. Preferably, when these salts are used the composition should be essentially free of zinc and other incompatible metal ions, e.g., Ca, Fe, Ba, etc. which form water-insoluble salts.

Enzymes

Enzymes can be used to control certain types of malodor, especially malodor from urine and other types of excretions, including regurgitated materials. Proteases are especially desirable. The activity of commercial enzymes depends very much on the type and purity of the enzyme being considered. Enzymes that are water soluble proteases like pepsin, tripsin, ficin, bromelin, papain, rennin, and mixtures thereof are particularly useful.

Enzymes are normally incorporated at levels sufficient to provide up to about 5 mg by weight, preferably from about 0.001 mg to about 3 mg, more preferably from about 0.002 mg to about 1 mg, of active enzyme per gram of the aqueous compositions. Stated otherwise, the aqueous compositions herein can comprise from about 0.0001% to about 0.5%, preferably from about 0.001% to about 0.3%, more preferably from about 0.005% to about 0.2% by weight of a commercial enzyme preparation. Protease enzymes are usually present in such commercial preparations at levels sufficient to provide from 0.0005 to 0.1 Anson units (AU) of activity per gram of aqueous composition.

Nonlimiting examples of suitable, commercially available, water soluble proteases are pepsin, tripsin, ficin, bromelin, papain, rennin, and mixtures thereof. Papain can be isolated, e.g., from papaya latex, and is available commercially in the purified form of up to, e.g., about 80% protein, or cruder, technical grade of much lower activity. Other suitable examples of proteases are the subtilisins which are obtained from particular strains of *B. subtilis* and *B. licheniforms*. Another suitable protease is obtained from a strain of *Bacillus*, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo. Proteolytic enzymes suitable for removing protein-based stains that are commercially available include those sold under the trade names ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985); Protease B (see European Patent Application Serial No. 87303761.8, filed Apr. 28, 1987, and European Patent Application 130,756, Bott et al, published Jan. 9, 1985); and proteases made by Genencor International, Inc., according to one or more of the following patents: Caldwell et al, U.S. Pat. Nos. 5,185,258, 5,204,015 and 5,244,791.

A wide range of enzyme materials and means for their incorporation into liquid compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Other enzyme materials useful for liquid formulations, and their incorporation into such formulations, are disclosed in U.S. Pat. No. 4,261,868, Hora et al, issued Apr. 14, 1981. Enzymes can be stabilized by various techniques, e.g., those disclosed and exemplified in U.S. Pat. No. 3,600,319, issued Aug. 17, 1971 to Gedge, et al., European Patent Application Publication No. 0 199 405, Application No. 86200586.5, published Oct. 29, 1986, Venegas, and in U.S. Pat. No. 3,519,570. All of the above patents and applications are incorporated herein, at least in pertinent part.

Enzyme-polyethylene glycol conjugates are also preferred. Such polyethylene glycol (PEG) derivatives of enzymes, wherein the PEG or alkoxy-PEG moieties are coupled to the protein molecule through, e.g., secondary amine linkages. Suitable derivatization decreases immunogenicity, thus minimizes allergic reactions, while still maintaining some enzymatic activity. An example of protease-PEG's is PEG-subtilisin Carlsberg from *B. lichenniformis* coupled to methoxy-PEGs through secondary amine linkage, and is available from Sigma-Aldrich Corp., St. Louis, Mo.

Zeolites

When the clarity of the solution is not needed, and the solution is not sprayed on fabrics, other optional odor absorbing materials, e.g., zeolites and/or activated carbon, can also be used. A preferred class of zeolites is characterized as "intermediate" silicate/aluminate zeolites. The intermediate zeolites are characterized by $SiO_2/AlO_2$ molar ratios of less than about 10. Preferably the molar ratio of $SiO_2/AlO_2$ ranges from about 2 to about 10. The intermediate zeolites have an advantage over the "high" zeolites. The intermediate zeolites have a higher affinity for amine-type odors, they are more weight efficient for odor absorption because they have a larger surface area, and they are more moisture tolerant and retain more of their odor absorbing capacity in water than the high zeolites. A wide variety of intermediate zeolites suitable for use herein are commercially available as Valfor® CP301-68, Valfor® 300-63, Valfor® CP300-35, and Valfor® CP300-56, available from PQ Corporation, and the CBV100® series of zeolites from Conteka.

Zeolite materials marketed under the trade name Abscents® and Smellrite®, available from The Union Carbide Corporation and UOP are also preferred. These materials are typically available as a white powder in the 3–5 micron particle size range. Such materials are preferred over the intermediate zeolites for control of sulfur-containing odors, e.g., thiols, mercaptans.

Activated Carbon

The carbon material suitable for use in the present invention is the material well known in commercial practice as an absorbent for organic molecules and/or for air purification purposes. Often, such carbon material is referred to as "activated" carbon or "activated" charcoal. Such carbon is available from commercial sources under such trade names as; Calgon-Type CPG®; Type PCB®; Type SGL®; Type CAL®; and Type OL®.

Mixtures Thereof

Mixtures of the above materials are desirable, especially when the mixture provides control over a broader range of odors.

(x). Mixtures of Optional Ingredients

Any mixtures of optional ingredients are also suitable for the present invention.

D. Method for Testing Product Stability

The amount of dispersed phase in the clear or translucent product is a measure of the product stability. Generally a small amount of secondary phase(s) will remain dispersed in the clear product. However, when the amount of the secondary phase(s) becomes too high, particles of secondary phase(s) are likely to agglomerate or coalesce and separate from the primary phase resulting in inhomogeniety. The rate at which separation occurs is dependent on the density difference between the clear product and the dispersed phase, and the number of collisions between dispersed particles and this is dependent on the size and number of dispersed particles. Therefore, when the amount of secondary phase(s) is too high, the product should be consider unstable because it will rapidly separate. When the amount of secondary phase(s) is small or nonexistent, the clear products are generally stable for long periods of time. A rapid method of determining if a product is unstable is ultra-high speed centrifugation. Ultra-high speed centrifugation forces collisions between dispersed particles and thus forces product separation. The lower the amount of secondary phase(s) present and the more stable the dispersion, the smaller the volume of separated material will be after a reasonable period of ultra-centrifugation. When only small or ideally no separation occurs during ultra-centrifugation a product is considered stable for the uses disclosed within.

To test a composition for phase separation, the composition is loaded into a Beckman polyallomer centrifuge tube until the combined weight of the tube and the composition is 13.5+ or −0.02 g. Six tubes with equal weights of different compositions are placed in rotor buckets and placed on the rotor. The rotor is placed into the vacuum chamber. The rotor is placed under vacuum and the compositions are spun at 40,000 rpm for 16 hrs at 25° C. At the end of 16 hrs., the tubes are removed and examined for separation. When separation is detected, the length of the total composition in the tube is measured. The length of each phase is measured. The length of the longest phase is substracted from the entire length of the composition in the tube and then the result is divided by the entire length of the composition and multiplied by 100 to compute the % phase volume of the phase separation. Formulas are considered stable if the % phase volume is at or below 5%.

EXAMPLES

TABLE 1

Samples with conventional principal solvent levels.

| | Component Wt. % | | | | | | |
|---|---|---|---|---|---|---|---|
| | 1 | 2 | 3 | 4 | 5 | 6 | 7 |
| Diquat[1] 85% in Ethanol (EtOH) | 23.34 | 23.34 | 23.34 | 27.64 | 27.64 | 27.64 | 27.64 |
| EtOH from softener | 3.5 | 3.5 | 3.5 | 4.1 | 4.1 | 4.1 | 4.1 |
| Hexylene Glycol | 7.5 | 7.5 | 2.0 | 7.5 | 7.5 | 7.5 | 2.0 |
| TMPD[2] | 7.5 | 5.0 | 7.5 | 7.5 | 4.5 | 2.0 | 7.5 |
| Perfume | 1.0 | 1.0 | 1.0 | 1.0 | 1.0 | 1.0 | 1.0 |
| Water | bal. | bal. | bal. | bal. | bal. | bal. | bal. |
| Total Solvent | 18.5 | 16.0 | 13.0 | 19.1 | 16.1 | 13.6 | 13.4 |

TABLE 1-continued

Samples with conventional principal solvent levels.

| | Component Wt. % | | | | | | |
|---|---|---|---|---|---|---|---|
| | 1 | 2 | 3 | 4 | 5 | 6 | 7 |
| Level Appearance | Slightly Hazy | Cloudy | Cloudy | Clear | Clear | Cloudy | Cloudy |
| % phase split | none | 12.2% | 8.3% | none | none | 25% | 2.4% |

[1]Diquat softener = The products formed by quaternization of reaction products of fatty acid with N,N,N',N', tetraakis(hydroxyethyl)-1,6-diaminohexane.
[2]TMPD = 2,2,4-trimethyl pentane-1,3-diol.

TABLE 2

Examples of Monoalkyl quat used to reduce the level of the principal solvent 1,2-hexanediol level.

| | Component Wt. % | | |
|---|---|---|---|
| | 1 | 2 | 3 |
| Diquat[1] softener - 85% in Ethanol (EtOH) | 27.64 | 23.34 | 32.9 |
| EtOH from Softener | 4.14 | 3.5 | 4.9 |
| Adogen 461[3] | — | 6.0 | 4.5 |
| IPA from Adogen 461 | — | 1.8 | 0.9 |
| 1,2-Hexanediol | 9.0 | 2.0 | 5.0 |
| Perfume | 1.0 | 2.0 | 1.0 |
| Water | bal. | bal. | bal. |
| Total Solvent Level | 13.1 | 7.3 | 10.8 |
| Appearance | Clear | Clear | Clear |
| % phase split | none | none | none |

[3]Adogen 461 = cocoalkyl trimethyl quaternary ammonium chloride.

TABLE 3

Monoalkyl quat used to reduce the level of various principal solvents and to eliminate principal solvent

| | Component Wt. % | | | | | | | | |
|---|---|---|---|---|---|---|---|---|---|
| | 1 | 2 | 3 | 4 | 5 | 6 | 7 | 8 | 9 |
| Diquat[1] 85% in EtOH | 23.34 | 23.34 | 23.34 | 23.34 | 23.34 | 23.34 | 23.34 | 23.34 | 23.34 |
| EtOH from Softener | 3.5 | 3.5 | 3.5 | 3.5 | 3.5 | 3.5 | 3.5 | 3.5 | 3.5 |
| Adogen 461[3] | 7.0 | 7.0 | 6.3 | 6.5 | 6.0 | 6.7 | 7.6 | 7.0 | — |
| Adogen 417[4] | — | — | — | — | — | — | — | — | 17.5 |
| IPA from Adogens | 2.1 | 2.1 | 1.9 | 2.0 | 1.8 | 2.0 | 2.3 | 2.1 | 5.3 |
| TMPD[2] | 2.0 | | — | — | — | — | — | — | — |
| methyl lactate | | 2.0 | | | | | | | — |
| 2,5-hexanediol | — | | 2.0 | — | — | — | — | — | — |
| EHDiol[5] | — | — | — | 2.0 | — | — | — | — | 2.0 |
| Propylene Carbonate | — | — | — | — | 2.0 | — | — | — | — |
| Hexylene Glycol | — | — | — | — | — | 2.0 | — | — | — |
| 2-butyl-2-ethyl-1,3-propanediol | — | — | — | — | — | — | 2.0 | — | — |
| EtOH | — | — | — | — | — | — | — | 2.0 | — |
| Total Solvent Level | 7.6 | 7.6 | 7.4 | 7.5 | 7.3 | 7.5 | 7.8 | 7.6 | 10.8 |
| Perfume | 2.0 | 2.0 | 2.0 | 2.0 | 2.0 | 2.0 | 2.0 | 2.0 | 2.0 |
| Water | bal. | bal. | bal. | bal. | bal. | bal. | bal. | bal. | bal. |

TABLE 3-continued

Monoalkyl quat used to reduce the level of various principal solvents and to eliminate principal solvent

| | Component Wt. % | | | | | | | | |
|---|---|---|---|---|---|---|---|---|---|
| | 1 | 2 | 3 | 4 | 5 | 6 | 7 | 8 | 9 |
| Appearance | clear | clear | clear | clear | clear | clear | clear | clear | clear |
| % phase split | none | none | none | none | none | none | none | none | none |

[4]Adogen 417 = C16–18 unsaturated alkyl trimethyl quaternary ammonium chloride.
[5]EHDiol = 2-ehtyl-1,3-hexanediol.

TABLE 4

Monoalkyl quat used to reduce the level of various principal solvents in formulas with higher diquat levels vs. Table 3.

| | Component Wt. % | | | | | |
|---|---|---|---|---|---|---|
| | 1 | 2 | 3 | 4 | 5 | 6 |
| Diquat[1] 85% in EtOH | 32.9 | 32.9 | 32.9 | 32.9 | 32.9 | 32.9 |
| EtOH from Softener | 4.9 | 4.9 | 4.9 | 4.9 | 4.9 | 4.9 |
| Adogen 461[3] | 7.0 | 7.0 | 7.0 | 7.0 | 7.0 | 7.0 |
| IPA from Adogen 461[3] | 2.1 | 2.1 | 2.1 | 2.1 | 2.1 | 2.1 |
| TMPD[2] | 2.0 | — | — | — | — | — |
| Methyl lactate | — | 2.0 | — | — | — | — |
| 2,5-hexanediol | — | — | 2.0 | — | — | — |
| EHDiol[5] | — | — | | 2.0 | — | — |
| Propylene Carbonate | — | — | — | — | 2.0 | — |
| Hexylene Glycol | — | — | — | — | — | 2.0 |
| Total Solvent Level | 9.0 | 9.0 | 9.0 | 9.0 | 9.0 | 9.0 |
| Perfume | 2.0 | 2.0 | 2.0 | 2.0 | 2.0 | 2.0 |
| Water | bal. | Bal. | bal. | bal. | bal. | bal. |
| Appearance | clear | clear | clear | clear | clear | clear |
| % phase split | none | none | none | none | none | none |

TABLE 5

Formulation with monoalkyl quat and no added organic and/or principal solvent.

| | Component Wt. % 1 |
|---|---|
| Quat 85% in EtOH | 23.34 |
| EtOH from Softener | 3.5 |
| Adogen 461[3] | 8.0 |
| IPA from Adogen 461[3] | 2.4 |
| Total Solvent Level | 5.9 |
| Perfume | 2.0 |
| Water | bal. |
| Appearance | clear |
| % phase split | none |

TABLE 6

Cocamide and polar oil used to reduce the principal solvent and the total solvent level.

| | Component Wt. % | | |
|---|---|---|---|
| | 1 | 2 | 3 |
| Diquat[1] 85% in EtOH | 27.64 | 27.64 | 27.64 |
| EtOH from Softener | 4.1 | 4.1 | 4.1 |
| Rewopal ® C6[6] | 8.0 | 8.0 | — |
| Wickenol 158[7] | — | — | 6.5 |

TABLE 6-continued

Cocamide and polar oil used to reduce the principal solvent and the total solvent level.

| | Component Wt. % | | |
|---|---|---|---|
| | 1 | 2 | 3 |
| 1,2-Hexanediol | — | — | 8.6 |
| Hexylene Glycol | 7.5 | 2.0 | — |
| TMPD[2] | 2.0 | 7.5 | — |
| Total Solvent Level | 13.6 | 13.6 | 12.7 |
| Perfume | 1.0 | 1.0 | 1.0 |
| Water | bal. | bal. | bal. |
| Appearance | clear | clear | clear |
| % phase split | none | none | none |

[6]Rewopal ® C6 = an ethoxylated cocomonoethanolamide sold by Witco Corporation
[7]Wickenol 158[6] = dioctyl adipate from Akzo, Inc.

TABLE 7

Mixtures of Diquat softeners and conventional monoquat softeners

| | Component Wt. % |
|---|---|
| TEA Diester Quat[8] 85% in solvent | 10.0 |
| Ethanol (from TEA Quat[8]) | 0.75 |
| Hexylene glycol (from TEA Diester Quat) | 0.75 |
| Diquat[1] 85% in EtOH | 10.0 |
| EtOH (from Diquat[1]) | 1.5 |
| Adogen 461[3] | 9.8 |
| IPA (from Adogen 461[3]) | 2.9 |
| 1,2 Hexanediol | 2.0 |
| Total Solvent Level | 7.9 |
| Perfume | 2.50 |
| Water | balance |
| Appearance | clear |
| % phase split | none |

8. TEA Diester Quat=Methyl sulfate Quaternized condensation reaction of about 1.9 moles of canola fatty acid with one mole of triethanolamine.

The invention claimed is:

1. A clear or translucent liquid fabric softener composition comprising:

A. from about 1% to about 80% by weight of the composition, of a polyquaternary ammonium fabric softener active which either has a phase transition temperature in the presence of less than about 5% organic solvent or water of less than about 50° C. or which has no significant endothermic phase transition in the region −50° C. to 100° C., said active being in a bilayer;

B. a bilayer modifier comprising a nonionic surfactant containing from about 6 to about 22 carbon atoms in a hydrophobic chain ethoxylated with from about 2 to about ≦50 ethoxy groups.

C. an additional softener active, wherein said additional softener active has a single quaternary moiety and two long hydrophobic moieties.

2. The composition of claim 1, wherein there is less than about 3% by volume of a secondary dispersed phase.

3. The composition of claim 1, wherein there is less than about 1% by volume of a secondary dispersed phase.

4. The composition of claim 1, wherein said composition is essentially free of a secondary dispersed phase.

5. The composition of claim 1, wherein said polyquaternary ammonium fabric softener active has a phase transition temperature in the presence of less than about 5% organic solvent or water of less than about 35° C. and is present at a level of from about 5% to about 75% by weight of the composition; and further comprising a principal solvent having a ClogP of from about −2.0 to about 2.6 at a level of at least about 0.25% and less than about 13.5% by weight of the composition.

6. The composition of claim 1, wherein said polyquaternary ammonium salt has a phase transition temperature in the presence of less than about 5% organic solvent or water of less than about 20° C. and is present at a level of from about 15% to about 70% by weight of the composition; and further comprising a principal solvent having a ClogP of from about −1.7 to about 1.6 at a level of at least about 025% by weight of the composition and less than about 10% by weight of the composition.

7. The composition of claim 1, wherein said polyquaternary ammonium salt has a phase transition temperature in the presence of less than about 5% organic solvent or water of less than about 10° C. and is present at a level of from about 19% to about 65% by weight of the composition; and further comprising a principal solvent having a ClogP at from about −1.0 to about 1.0 at a level of at least about 0.5% by weight of the composition and less than about 7.5% by weight of the composition.

* * * * *